US010401101B2

(12) United States Patent
Kirkham

(10) Patent No.: US 10,401,101 B2
(45) Date of Patent: Sep. 3, 2019

(54) FIREARM SYSTEMS AND METHODS FOR ACCOMMODATING DIFFERENT BULLET CASING LENGTHS

(71) Applicant: William Clifford Kirkham, Cordova, IL (US)

(72) Inventor: William Clifford Kirkham, Cordova, IL (US)

(73) Assignee: William Clifford Kirkham, Cordova, IL (US)

( * ) Notice: Subject to any disclaimer, the term of this patent is extended or adjusted under 35 U.S.C. 154(b) by 0 days.

(21) Appl. No.: 16/132,035

(22) Filed: Sep. 14, 2018

(65) Prior Publication Data

US 2019/0101348 A1 Apr. 4, 2019

Related U.S. Application Data

(60) Provisional application No. 62/567,711, filed on Oct. 3, 2017.

(51) Int. Cl.
*F41A 3/64* (2006.01)
*F41A 19/43* (2006.01)
*F41C 3/00* (2006.01)

(52) U.S. Cl.
CPC ..... *F41A 3/64* (2013.01); *F41A 19/43* (2013.01); *F41C 3/00* (2013.01)

(58) Field of Classification Search
CPC .... F41A 3/64; F41A 3/00; F41A 19/16; F41A 19/43; F41A 3/12; F41A 3/60; F41A 3/66
See application file for complete search history.

(56) References Cited

U.S. PATENT DOCUMENTS 3,733,731 A * 5/1973 Nicholson ..... F41A 3/22 42/16
4,440,062 A * 4/1984 McQueen ..... F41A 15/14 89/128
4,617,749 A * 10/1986 Jurek ..... F41A 17/36 42/16
4,679,486 A * 7/1987 Landaas ..... F41A 3/60 89/1.41
4,748,759 A * 6/1988 Whiteing ..... F41C 9/00 42/1.09
6,212,991 B1 * 4/2001 Frazier, III ..... F41A 3/82 42/16

(Continued)

*Primary Examiner* — Michelle Clement
(74) *Attorney, Agent, or Firm* — Foley & Lardner LLP

(57) ABSTRACT

A firearm includes a frame, a slide assembly, an actuator, a bolt assembly, and an adjuster. The slide assembly includes a threaded bore, the slide assembly releasably and slidably coupled to the frame. The actuator includes a body and an extension, the extension protruding from the body. The bolt assembly includes a catch. The adjuster includes a first end, a second end, and a plurality of threads. The first end includes an interface configured to accommodate the extension of the actuator. The plurality of threads are disposed between the first end and the second end. The plurality of threads are configured to interface with the threaded bore of the slide assembly such that rotation of the adjuster within the threaded bore of the slide assembly by the actuator translates the bolt assembly and thereby facilitates firing ammunition having different casing lengths.

9 Claims, 26 Drawing Sheets

(56) References Cited

U.S. PATENT DOCUMENTS

| | | | | |
|---|---|---|---|---|
| 6,360,467 | B1 * | 3/2002 | Knight | F41A 3/06 42/16 |
| 7,340,987 | B1 * | 3/2008 | Williams | F41A 3/64 42/15 |
| 10,247,500 | B2 * | 4/2019 | Owens | F41A 11/02 |
| 2002/0178632 | A1 * | 12/2002 | Strayer | F41A 3/64 42/16 |
| 2005/0188578 | A1 * | 9/2005 | Engel | F41A 3/18 42/16 |
| 2006/0037464 | A1 * | 2/2006 | Moore | F41A 3/12 89/125 |
| 2006/0162217 | A1 * | 7/2006 | Longueira | F41A 19/15 42/16 |
| 2009/0031605 | A1 * | 2/2009 | Robinson | F41A 15/12 42/2 |
| 2010/0307042 | A1 * | 12/2010 | Jarboe | F41A 3/18 42/6 |
| 2011/0265638 | A1 * | 11/2011 | Overstreet | F41A 3/64 89/128 |
| 2012/0073177 | A1 * | 3/2012 | Laney | F41C 23/16 42/16 |
| 2014/0298703 | A1 * | 10/2014 | Gale | F41C 27/00 42/71.02 |
| 2015/0135573 | A1 * | 5/2015 | DiChario | F41A 3/66 42/75.02 |
| 2015/0323268 | A1 * | 11/2015 | Kokinis | F41A 11/02 89/193 |
| 2016/0146558 | A1 * | 5/2016 | Kada | F41A 3/56 42/16 |
| 2016/0245608 | A1 * | 8/2016 | Hayes | F41A 21/10 |
| 2018/0031343 | A1 * | 2/2018 | Caudle | F41A 11/02 |
| 2018/0245868 | A1 * | 8/2018 | Dechant | F41A 3/64 |

* cited by examiner

FIREARM SYSTEMS AND METHODS FOR ACCOMMODATING DIFFERENT BULLET CASING LENGTHS

CROSS-REFERENCE TO RELATED APPLICATIONS

This application claims the benefit of U.S. Provisional Patent Application No. 62/567,711, filed Oct. 3, 2017, which is incorporated herein by reference in its entirety.

BACKGROUND

Firearms have long required the use of bullets having casings of specific dimensions. For example, a firearm chambered to fire 9 mm cartridges has traditionally required the use of 9 mm cartridges. Cartridges having bullets of the same diameter and the same style casings but with different casing lengths could not be interchangeably fired from the same firearm.

SUMMARY

The embodiments of this invention allow for ammunition having the same projectile diameter but different casing lengths to be fired interchangeably from a single firearm. The various embodiments are directed at different operational methods of different firearms.

One embodiment relates to a firearm that is recoil operated and includes a frame, a slide assembly, an actuator, a bolt assembly, and an adjuster. The slide assembly includes a threaded bore, the slide assembly releasably and slidably coupled to the frame. The actuator includes a body and an extension, the extension protruding from the body. The bolt assembly includes a catch. The adjuster includes a first end, a second end, and a plurality of threads. The first end includes an interface configured to accommodate the extension of the actuator. The second end includes a coupler configured to engage with the catch of the bolt assembly. The plurality of threads are disposed between the first end and the second end. The plurality of threads are configured to interface with the threaded bore of the slide assembly such that rotation of the adjuster within the threaded bore of the slide assembly by the actuator translates the bolt assembly and thereby facilitates firing ammunition having different casing lengths.

Another embodiment relates to a firearm that is blowback operated and includes a frame assembly, a barrel, a slide assembly releasably and slidably coupled to the frame assembly, a bolt assembly including a surface, a firing pin, and an adjuster. The slide assembly defines a lateral aperture. The adjuster includes a body defining a first bore, defining a leading surface, and having a thickness. The leading surface is configured to interface with a rear portion of a cartridge. The thickness of the body spaces the leading surface from the surface of the bolt assembly. The extension couples the body to the bolt assembly. The extension defines a second bore adjacent to, and sharing a common axis with, the first bore, wherein the first bore and the second bore receive the firing pin.

Yet another embodiment relates to a method of accommodating firing different lengths of cartridges with a single recoil operated firearm. The method includes providing a firearm configured to fire a first cartridge of a first length, manipulating an adjuster assembly to accommodate firing a second cartridge of a second length, and discharging the firearm to fire the second cartridge. Manipulating the adjuster assembly includes rotating an actuator to a position in which a hammer of the firearm is receivable by the actuator, rotating an adjuster within a threaded bore of the firearm, and translating a bolt assembly into a position whereby the second cartridge is fireable from the firearm.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a firearm includes an adjuster assembly configured to facilitate interchangeably firing cartridges having bullets of the same diameter and the same style casings but with different casing lengths. In other words, the adjuster assembly is configured to facilitate firing rounds having different casing lengths from the same firearm. In one embodiment, the firearm is a pistol. The pistol may be recoil operated, blow back operated and/or gas delayed blow back operated. Regardless of the pistol operation, the adjuster assembly is configured to selectively reposition a rear (e.g., relative to the end of the barrel from which the bullet is expelled, relative to the muzzle of the firearm, etc.) portion (e.g., a rear face, a rear edge, etc.) of the bullet relative to the barrel. The adjuster assembly thereby facilitates providing similar head space regardless of the length of the casing. In one embodiment, the firearm including the adjuster assembly provides increased flexibility to the operator in that cartridges having different casing lengths may be interchangeably fired. In another embodiment, the firearm including the adjuster assembly additionally or alternatively reduces the cost of ownership in that the operator may use certain, less expensive cartridges for training and/or target practice and then use other, more expensive cartridges for live fire exercises.

Figure 1:
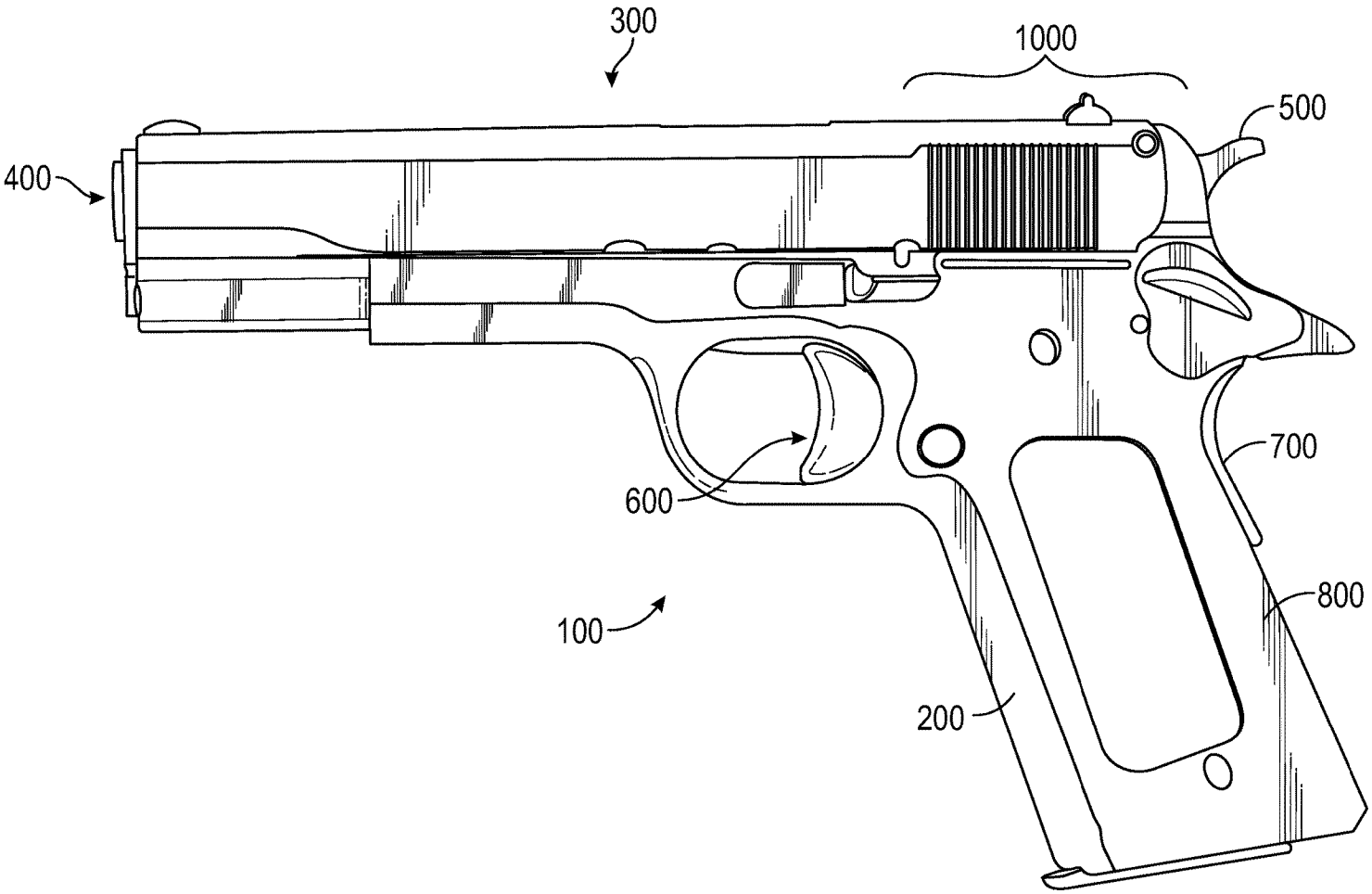
FIG. 1 is a side view of a recoil operated firearm having an adjuster assembly, according to an exemplary embodiment.
Figure 2:
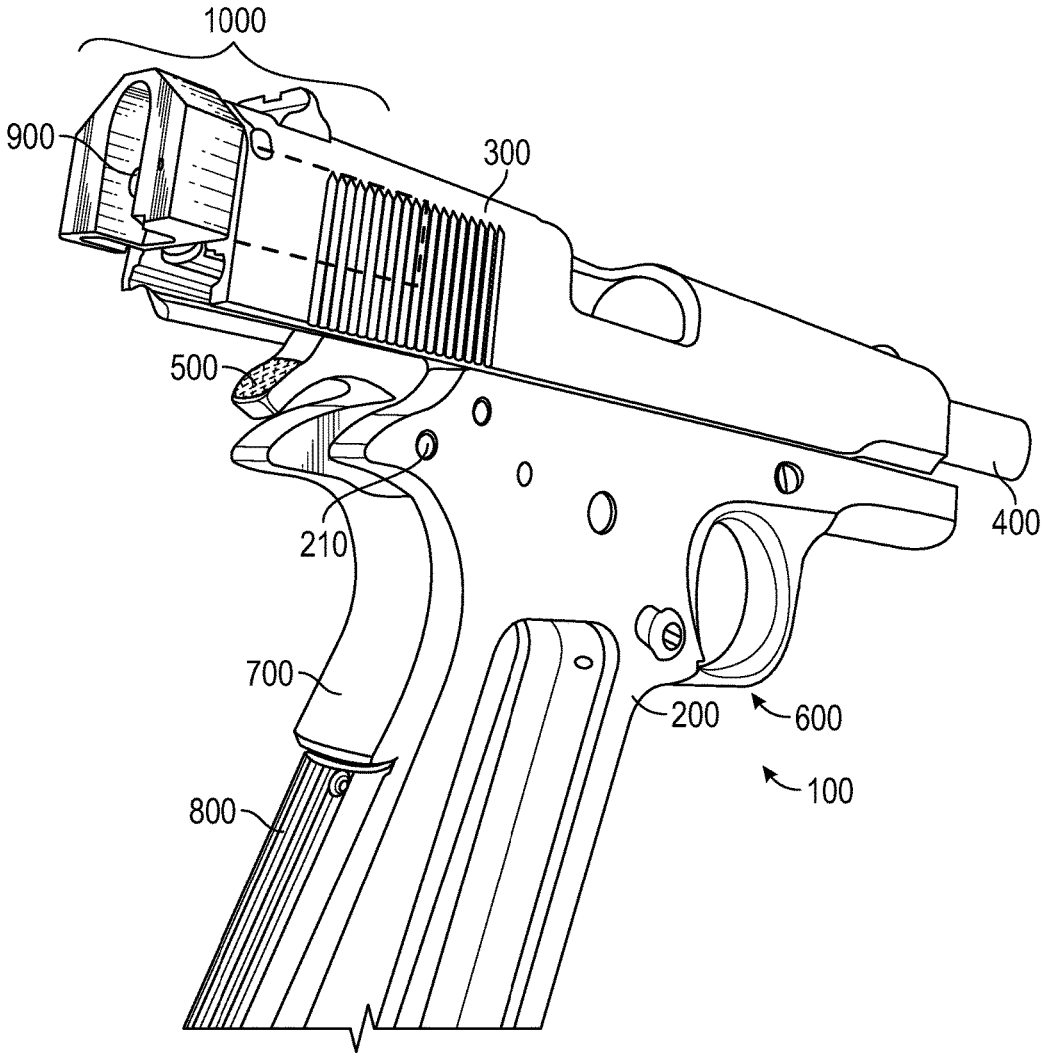
FIG. 2 is a rear perspective view of the firearm of FIG. 1, according to an exemplary embodiment.

According to the exemplary embodiment shown in FIGS. 1 and 2, a firearm, shown as pistol 100, includes a frame assembly, shown as frame assembly 200, a slide assembly, shown as slide assembly 300, and a barrel, shown as barrel 400. As shown in FIGS. 1 and 2, pistol 100 is recoil operated. Slide assembly 300 is releasably and slidably coupled to frame assembly 200. As shown in FIGS. 1 and 2, pistol 100 also includes a hammer, shown as hammer 500, a trigger assembly, shown as trigger assembly 600, a safety, shown as safety 700, a grip, shown as grip 800, and a firing assembly, shown as firing assembly 900. Pistol 100 may alternatively include more or fewer components (e.g., pistol 100 may not include grip 800, etc.). As shown in FIG. 2, pistol 100 includes a plurality of fasteners, shown as pins 210. Pins 210 may couple various other components of pistol 100 to frame assembly 200. By way of example, pins 210 may couple trigger assembly 600 to frame assembly 200. According to the exemplary embodiment shown in FIGS. 1 and 2, pistol 100 includes an adjuster assembly, shown as adjuster assembly 1000. In one embodiment, adjuster assembly 1000 is configured to selectively reposition a rear portion of a cartridge relative to barrel 400 thereby providing increased flexibility to the operator in that cartridges having different casing lengths may be interchangeably fired from pistol 100.

Figure 3:
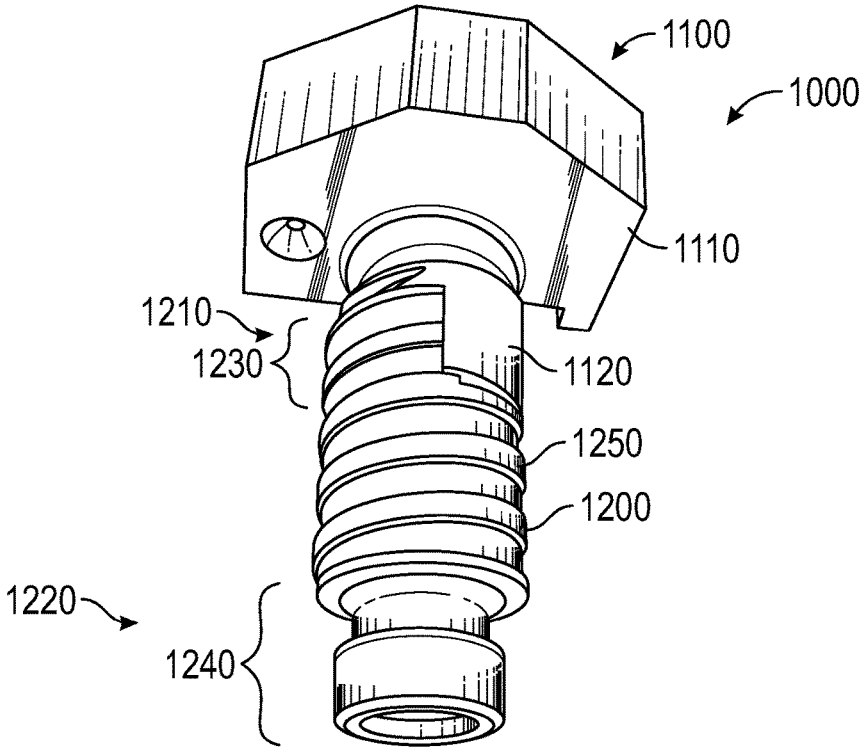
FIG. 3 is a perspective view of the adjuster assembly of the firearm of FIG. 1, according to an exemplary embodiment.

According to the exemplary embodiment shown in FIG. 3, adjuster assembly 1000 includes an actuator, shown as knob 1100, and an adjuster, shown as adjuster 1200. An operator may engage knob 1100 to selectively reconfigure pistol 100 into various orientations (e.g., between two orientations, etc.) and thereby facilitate interchangeably firing cartridges having different casing lengths. Knob 1100 engages adjuster 1200, according to an exemplary embodiment. As shown in FIG. 3, knob 1100 includes a body, shown as body 1110, and an extension, shown as extension 1120, that protrudes therefrom. Adjuster 1200 is elongated and has a first end 1210 and a second end 1220. As shown in FIG. 3, adjuster 1200 includes an interface, shown as interface 1230, at first end 1210 and a coupler, shown as coupler 1240, at second end 1220. Extension 1120 of knob 1100 and interface 1230 of adjuster 1200 have mating shapes, according to an exemplary embodiment. A portion of adjuster 1200 has a circular cross-sectional shape, according to an exemplary embodiment. In other embodiments, adjuster 1200 has another cross-sectional shape (e.g., square, etc.). Interface 1230 has the cross-sectional shape (e.g., in a plane to which a longitudinal axis of adjuster 1200 is orthogonal, etc.) of a circle sector (e.g., a half-disk, etc.), according to an exemplary embodiment. Extension 1120 also has the cross-sectional shape (e.g., in a plane parallel to a surface of body 1110, in a plane to which a longitudinal axis of adjuster 1200 is orthogonal, etc.) of a circle sector (e.g., a half-disk, etc.), according to an exemplary embodiment. An operator may manipulate knob 1100 to selectively reorient adjuster 1200. By way of example, an operator may rotate knob 1100, and engagement between extension 1120 and interface 1230 may rotate adjuster 1200.

Figure 4:
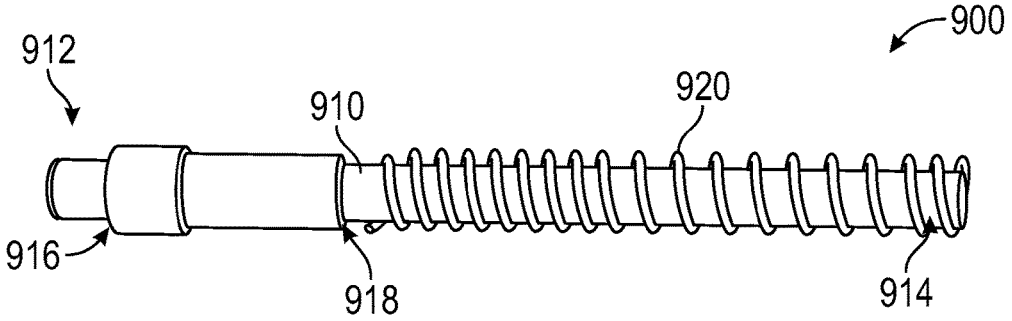
FIG. 4 is a perspective view of a firing assembly of the firearm of FIG. 1, according to an exemplary embodiment.

As shown in FIG. 4, firing assembly 900 includes a firing pin, shown as firing pin 910, and a resilient member, shown as spring 920. In one embodiment, knob 1100 receives firing pin 910. By way of example, firing pin 910 may protrude from a surface of knob 1100. Hammer 500 of pistol 100 is configured to strike a first end 912 of firing pin 910, thereby driving a second end 914 of firing pin 910 into a primer of the cartridge to fire the round. In one embodiment, firing pin 910 includes a first interface, shown as shoulder 916, and a second interface, shown as shoulder 918. Spring 920 is configured to interface with shoulder 918 and bias shoulder 916 into engagement with a surface of knob 1100, according to an exemplary embodiment.

Figure 5:
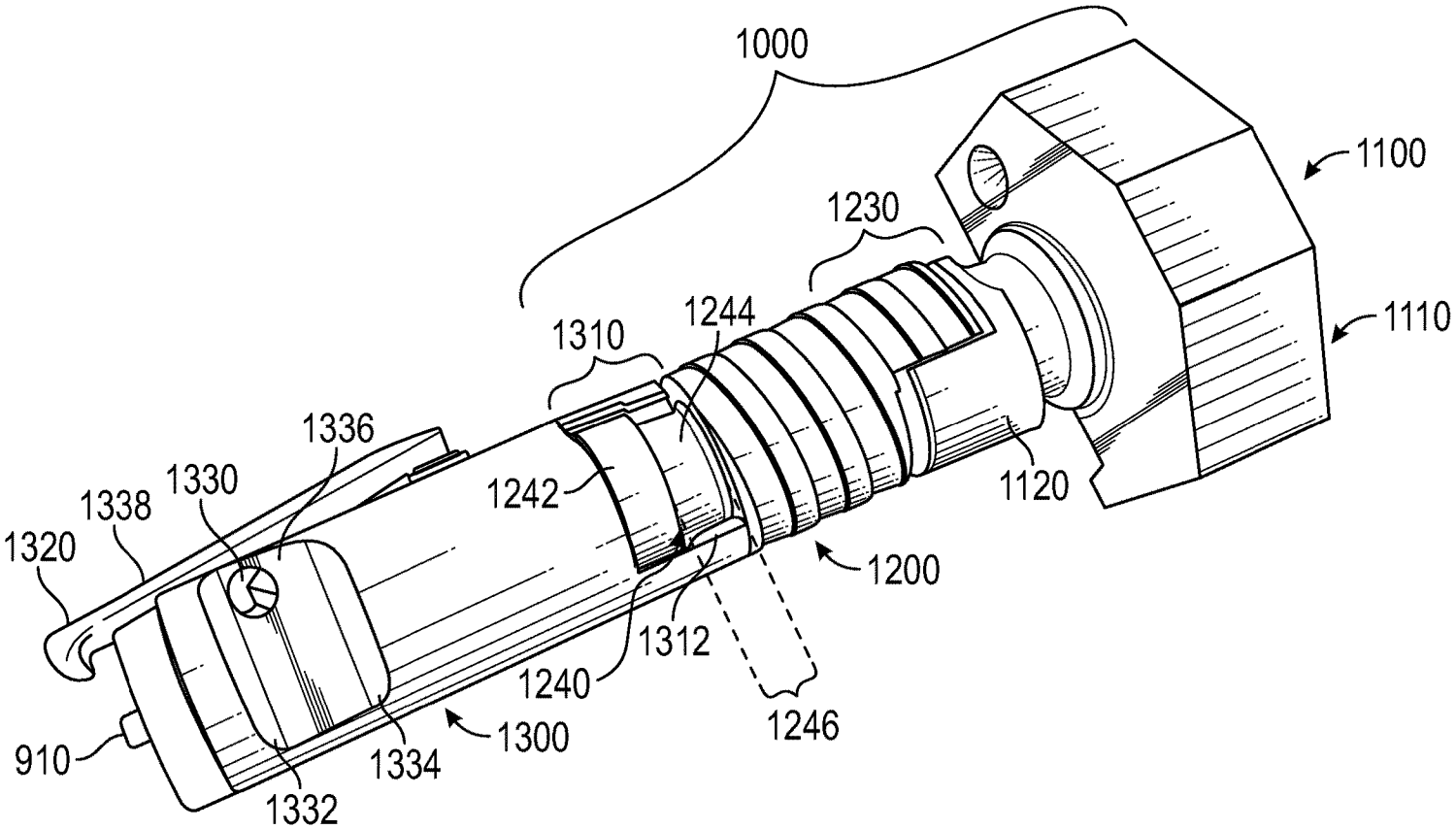
FIG. 5 is a perspective view of the adjuster assembly and a bolt assembly of the firearm of FIG. 1, according to an exemplary embodiment.

As shown in FIG. 5, adjuster assembly 1000 interfaces with a bolt assembly, shown as bolt assembly 1300. Bolt assembly 1300 and adjuster assembly 1000 (e.g., adjuster 1200, etc.) receives firing assembly 900, according to an exemplary embodiment. As shown in FIG. 5, firing pin 910 protrudes from bolt assembly 1300 (e.g., when hammer 500 engages with an opposing end thereof, etc.). Coupler 1240 of adjuster 1200 engages an interface, shown as interface 1310, of bolt assembly 1300, according to an exemplary embodiment. In one embodiment, interface 1310 is defined by a bolt of bolt assembly 1300. As shown in FIG. 5, coupler 1240 of adjuster 1200 includes a first portion 1242 and a second portion 1244 that cooperate with other portions of adjuster 1200 to define a recess 1246. Recess 1246 receives a catch, shown as catch 1312, of interface 1310 of bolt assembly 1300, according to an exemplary embodiment. Engagement of catch 1312 with first portion 1242 couples bolt assembly 1300 to adjustment assembly 1000 while facilitating relative motion therebetween, according to an exemplary embodiment. By way of example, adjuster 1200 may be rotated (e.g., through rotation of knob 1100 by an operator, etc.), and adjuster 1200 may remain coupled to bolt assembly 1300 without causing rotation thereof (e.g., first portion 1242 and second portion 1244 of adjuster 1200 may rotate with interface 1310 of bolt assembly 1300, etc.). As shown in FIG. 5, first portion 1242 and second portion 1244 have a circular cross-sectional shape (e.g., within a plane to which a longitudinal axis of adjuster 1200 is orthogonal, etc.), and catch 1312 similarly has a circular cross-sectional shape (e.g., within a plane to which a longitudinal axis of bolt assembly 1300 is orthogonal, etc.). In other embodiments, first portion 1242, second portion 1244, and/or catch 1312 have a different cross-sectional shape.

According to the exemplary embodiment shown in FIG. 5, bolt assembly 1300 includes an extractor, shown as extractor 1320. Extractor 1320 interfaces with a casing of a cartridge (e.g., a rim at the base thereof, etc.) to pull the casing rearward, according to an exemplary embodiment. In other embodiments, bolt assembly 1300 does not include extractor 1320 and instead includes other components configured to reposition the casing.

As shown in FIG. 5, bolt assembly 1300 defines a recess, shown as slot 1330. In one embodiment, slot 1330 is defined by the bolt of bolt assembly 1300. Slot 1330 is positioned across an upper portion of bolt assembly 1300, according to an exemplary embodiment. As shown in FIG. 5, slot 1330 is defined by a leading edge 1332, a trailing edge 1334, and an adjoining surface 1336. A length of slot 1330 extends between leading edge 1332 and trailing edge 1334, and a width of slot 1330 extends perpendicular to the length thereof. Bolt assembly also defines a notch, shown as notch 1338, that accommodates and/or receives the end of barrel 400 in one or more positions of bolt assembly 1300 (e.g., when bolt assembly 1300 is disposed in a forward position, etc.).

Figure 6:
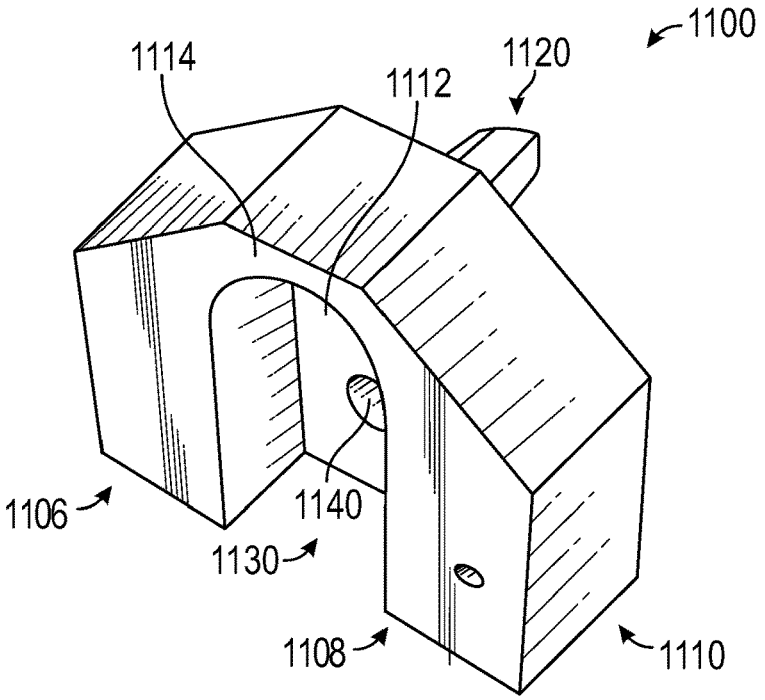
FIG. 6 is a perspective view of an adjuster knob of the adjuster assembly of the firearm of FIG. 1, according to an exemplary embodiment.

As shown in FIG. 6, body 1110 of knob 1100 defines a recess, shown as recess 1130. Recess 1130 is configured to selectively receive hammer 500 of pistol 100, according to an exemplary embodiment. In one embodiment, knob 1100 defines an aperture, shown as bore 1140, that is configured to receive firing pin 910 of firing assembly 900. Firing pin 910 may protrude from a first surface 1112 of body 1110 in an extended position and be driven from the extended position by hammer 500 (e.g., as hammer 500 strikes firing pin 910, etc.). In one embodiment, the portion of body 1110 that defines first surface 1112 serves as a retainer plate that holds firing pin 910 in place.

Recess 1130 has the shape of an arched doorway, according to an exemplary embodiment. As shown in FIG. 6, recess 1130 extends to and through a lower end of body 1110 and is spaced from an upper end of body 1110 such that a rim, shown as rim 1114, is formed along an upper portion of body 1110. Recess 1130 is laterally defined by a first wing and a second wing, shown in FIG. 6 as first wing 1106 and second wing 1108. Recess 1130 receives hammer 500 of pistol in certain orientations. By way of example, hammer 500 may extend through the open lower end of body 1110 (e.g., the portion thereof that defines recess 1130, etc.) and strike firing pin 910 to fire the cartridge. Rim 1114, first wing 1106, and second wing 1108 may prevent hammer 500 from entering recess 1130 and striking firing pin 910 in certain orientations of knob 1100 (e.g., when knob 1100 is upside down, when knob 1100 is rotated 180 degrees from the orientation shown in FIG. 6 about an axis along which extension 1120 protrudes, etc.).

Figure 7:
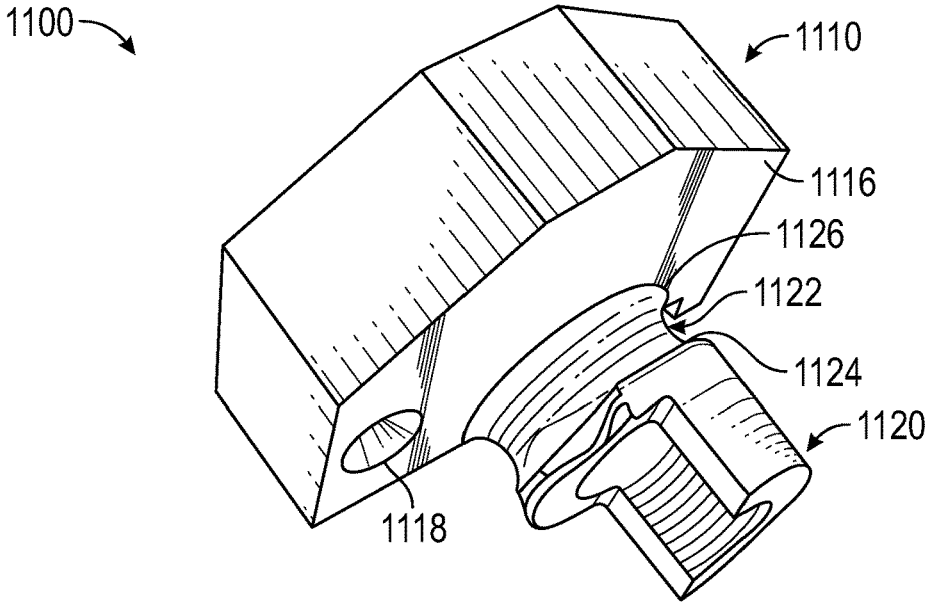
FIG. 7 is another perspective view of an adjuster knob of the adjuster assembly of the firearm of FIG. 1, according to an exemplary embodiment.

As shown in FIG. 7, body 1110 of knob 1100 is defined by a second surface 1116. A detent, shown as detent 1118, is formed in second surface 1116, according to the exemplary embodiment shown in FIG. 7. Detent 1118 may cooperate with a retainer of slide assembly 300 to hold knob 1100 in position.

According to the exemplary embodiment shown in FIG. 7, extension 1120 defines a recess, shown as groove 1122. Groove 1122 extends inward, toward a longitudinal centerline of extension 1120 from an outer surface thereof, according to an exemplary embodiment. As shown in FIG. 7, groove 1122 is defined between a leading edge 1124 and a trailing edge 1126 of extension 1120. In other embodiments, groove 1122 is otherwise defined (e.g., between leading edge 1124 and second surface 1116 of body 1110, etc.).

Figure 8:
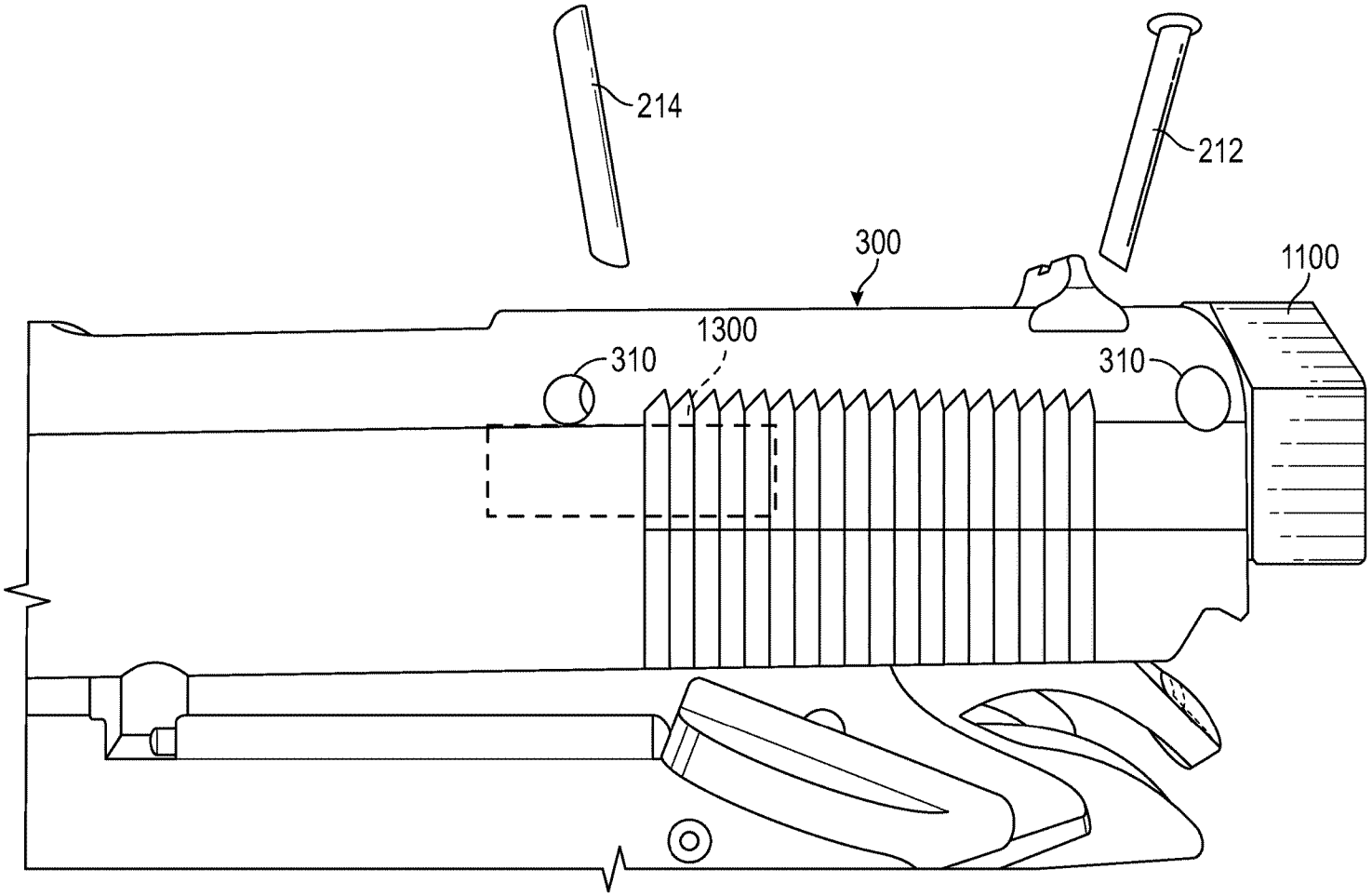
FIG. 8 is a side partially-exploded view of the firearm of FIG. 1, according to an exemplary embodiment.

As shown in FIG. 8, slide assembly 300 defines apertures 310. In one embodiment, apertures 310 are configured (e.g., sized, etc.) to receive a first pin 212 and a second pin 214. First pin 212 and second pin 214 may be the same or different sizes (e.g., diameters, etc.), according to various embodiments. In one embodiment, knob 1100 is coupled to slide assembly 300 with first pin 212, and bolt assembly 1300 is coupled to slide assembly 300 with second pin 214. By way of example, groove 1122 of extension 1120 of knob 1100 may receive first pin 212. Engagement between first pin 212 and extension 1120 may limit translational movement between knob 1100 and slide assembly 300. Groove 1122 may extend circumferentially around extension 1120 such that knob 1100 is freely rotatable (e.g., 360 degrees, etc.) about a central axis thereof relative to slide assembly 300. First pin 212 may thereby hold knob 1100 within slide assembly 300. By way of another example, slot 1330 of bolt assembly 1300 may receive second pin 214. Engagement between second pin 214 and the bolt of bolt assembly 1300 (e.g., contact between second pin 214 and adjoining surface 1336, etc.) may limit rotational movement between bolt assembly 1300 and slide assembly 300. The length of slot 1330 facilitates limited translational movement between bolt assembly 1300 and slide assembly 300. By way of example, second pin 214 may contact trailing edge 1334 of bolt assembly 1300 when bolt assembly 1300 is in a first position (e.g., an extended position, etc.), and second pin 214 may contact leading edge 1332 of bolt assembly 1300 when bolt assembly 1300 is in a second position (e.g., a withdrawn position, a retracted position, etc.).

Figure 9:
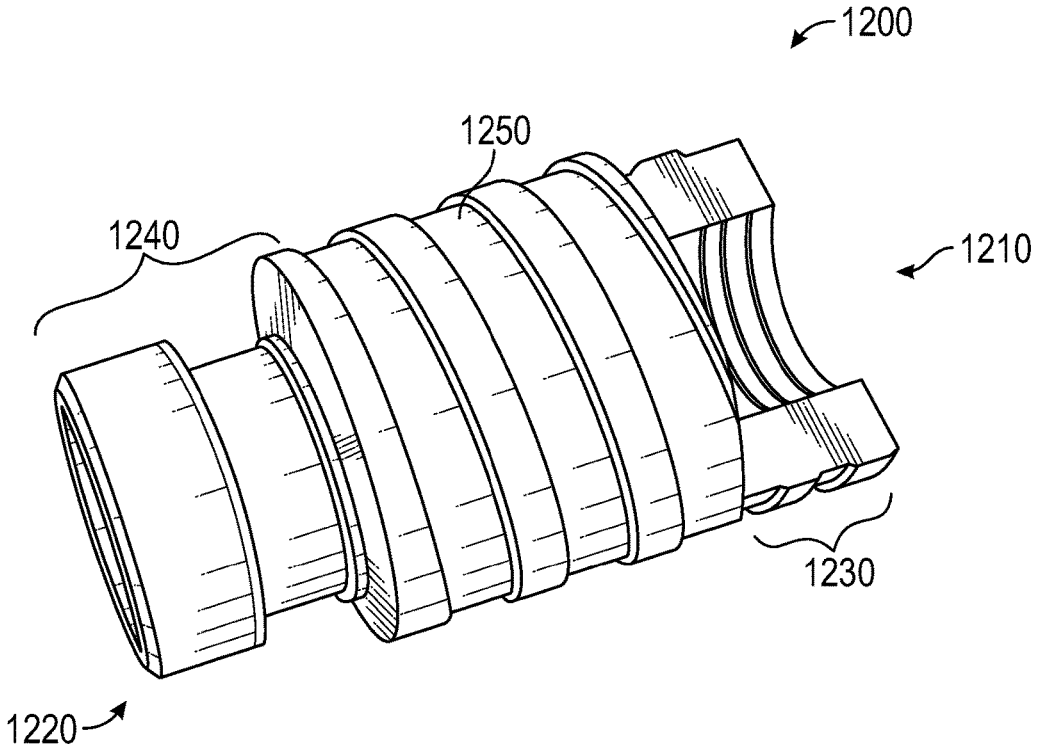
FIG. 9 is a perspective view of an adjuster of the adjuster assembly of the firearm of FIG. 1, according to an exemplary embodiment.

As shown in FIG. 9, adjuster 1200 includes a plurality of threads 1250. The plurality of threads 1250 may be acme square threads or another type of thread, according to various embodiments. According to the embodiment shown in FIG. 9, the plurality of threads 1250 are defined within a surface of adjuster 1200 and disposed between (e.g., longitudinally between, etc.) interface 1230 and coupler 1240.

Figure 10:
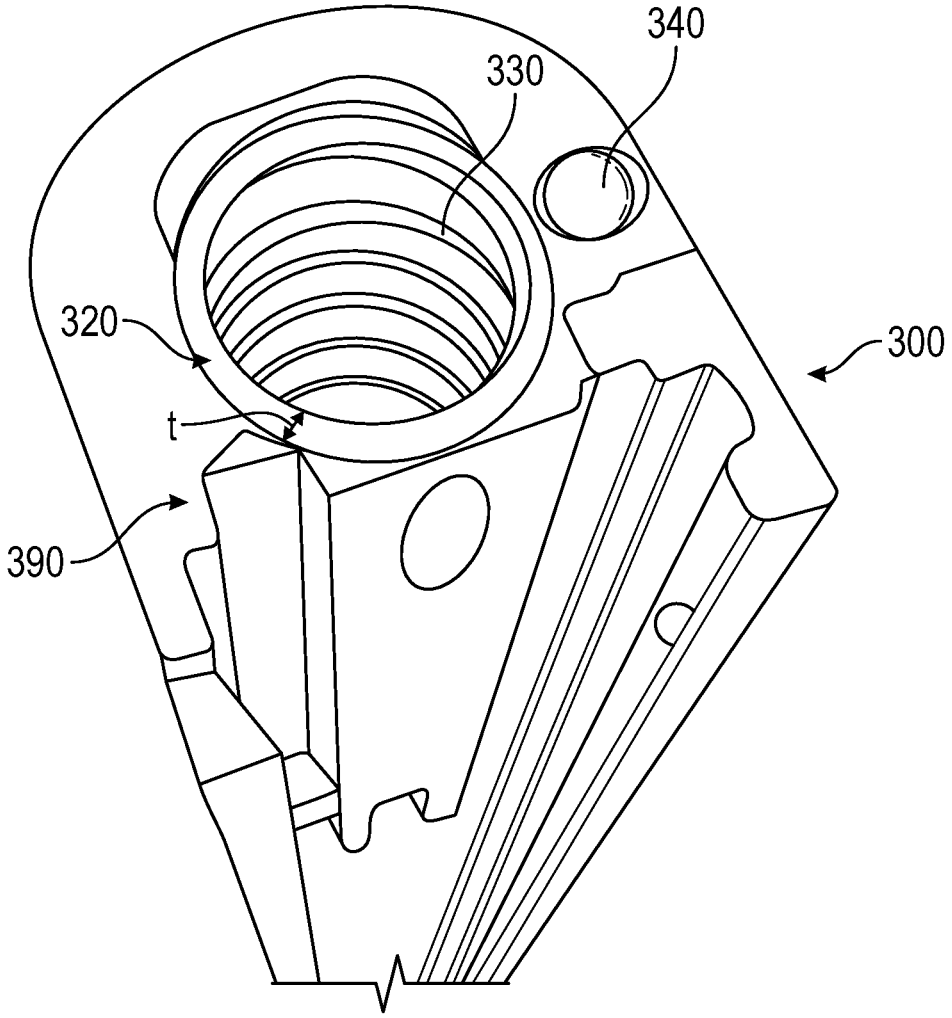
FIG. 10 is a perspective view of a slide of the firearm of FIG. 1, according to an exemplary embodiment.

As shown in FIG. 10, slide assembly 300 includes a bore, shown as bore 320 defined along a length thereof. Slide assembly 300 includes a plurality of threads 330 within bore 320. In one embodiment, the plurality of threads 330 within bore 320 correspond with the plurality of threads 1250 of adjuster 1200. Slide assembly 300 may thereby receive adjuster 1200 within bore 320. Adjuster 1200 may be threaded into bore 320 (e.g., by engagement of the plurality of threads 1250 of adjuster 1200 with the plurality of threads 330 within bore 320, etc.). As adjuster 1200 is rotated relative to slide assembly 300, adjuster 1200 is fed into or withdrawn from bore 320 (i.e., rotational movement of adjuster 1200 produces longitudinal movement thereof, etc.). In one embodiment, rotation of adjuster 1200 thereby selectively repositions bolt assembly 1300 between the first position and the second position due to engagement between coupler 1240 and interface 1310. According to an exemplary embodiment, bolt assembly 1300 (e.g., a body thereof, etc.)

has a diameter that is larger than the outer diameter of adjuster 1100 and/or the inner diameter of slide assembly 300. Bolt assembly 1300 may thereby be sized to prevent inadvertent discharge of bolt assembly 1300 out the back of slide assembly 300.

As shown in FIG. 10, slide assembly 300 includes a retainer, shown as retainer 340. Retainer 340 is a ball configured to engage with detent 1118 to selectively hold knob 1100 in a desired position, according to an exemplary embodiment. A resilient member (e.g., a spring, etc.) may bias retainer 340 outward, away from slide assembly 300.

Figure 11:
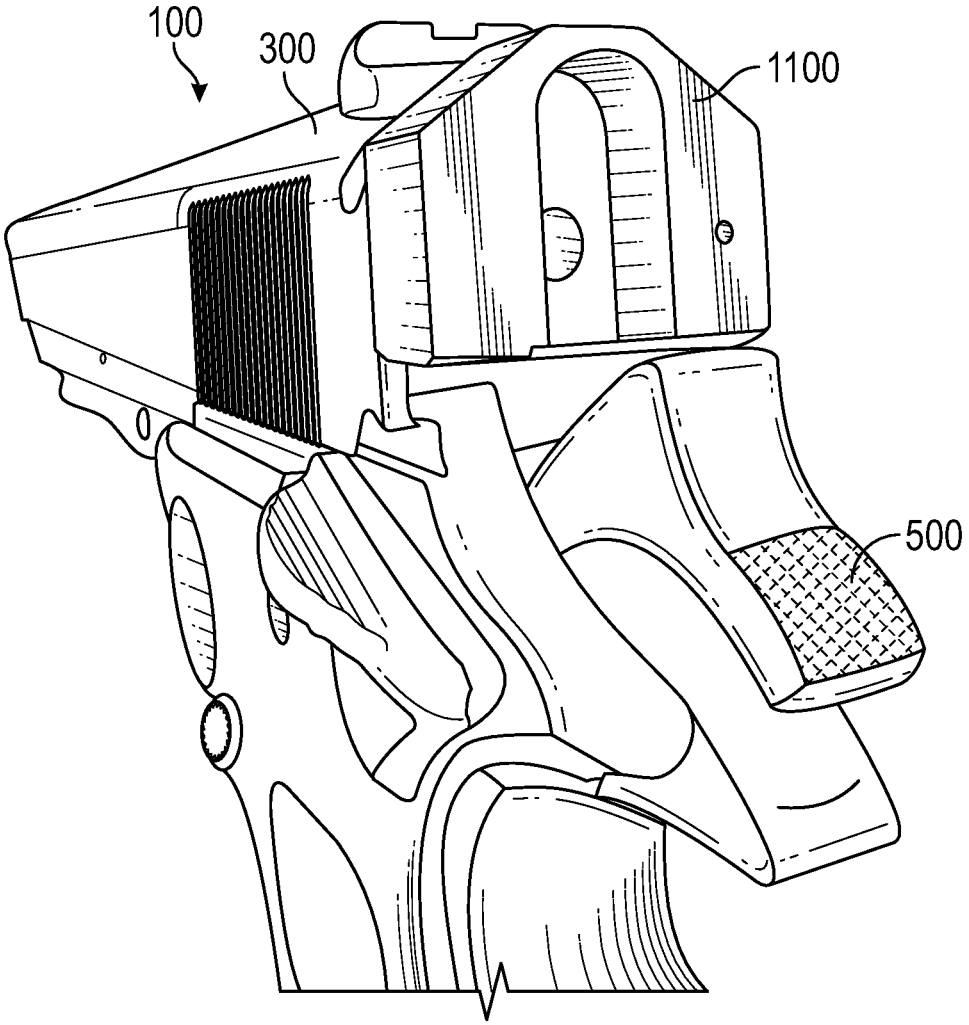
FIGS. 11-15 are rear perspective views of the firearm of FIG. 1 with the adjuster knob and slide thereof in various orientations, according to an exemplary embodiment.
Figure 12:
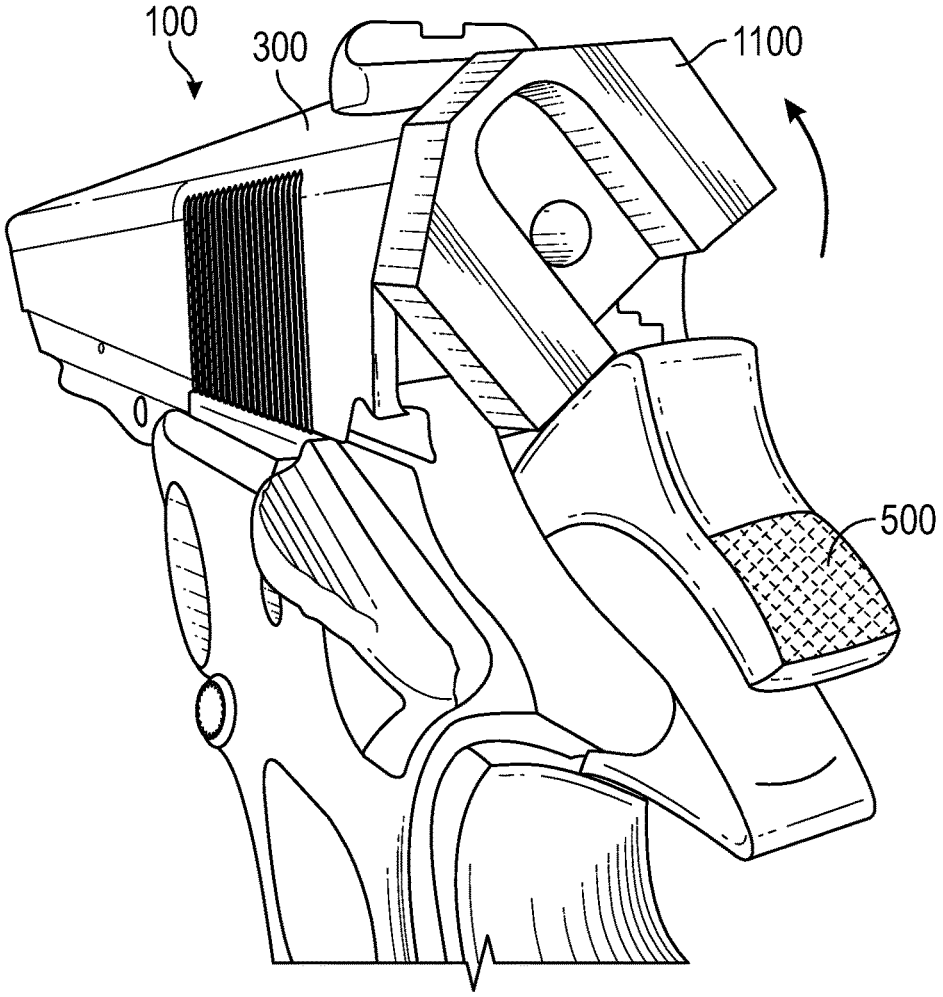
Figure 13:
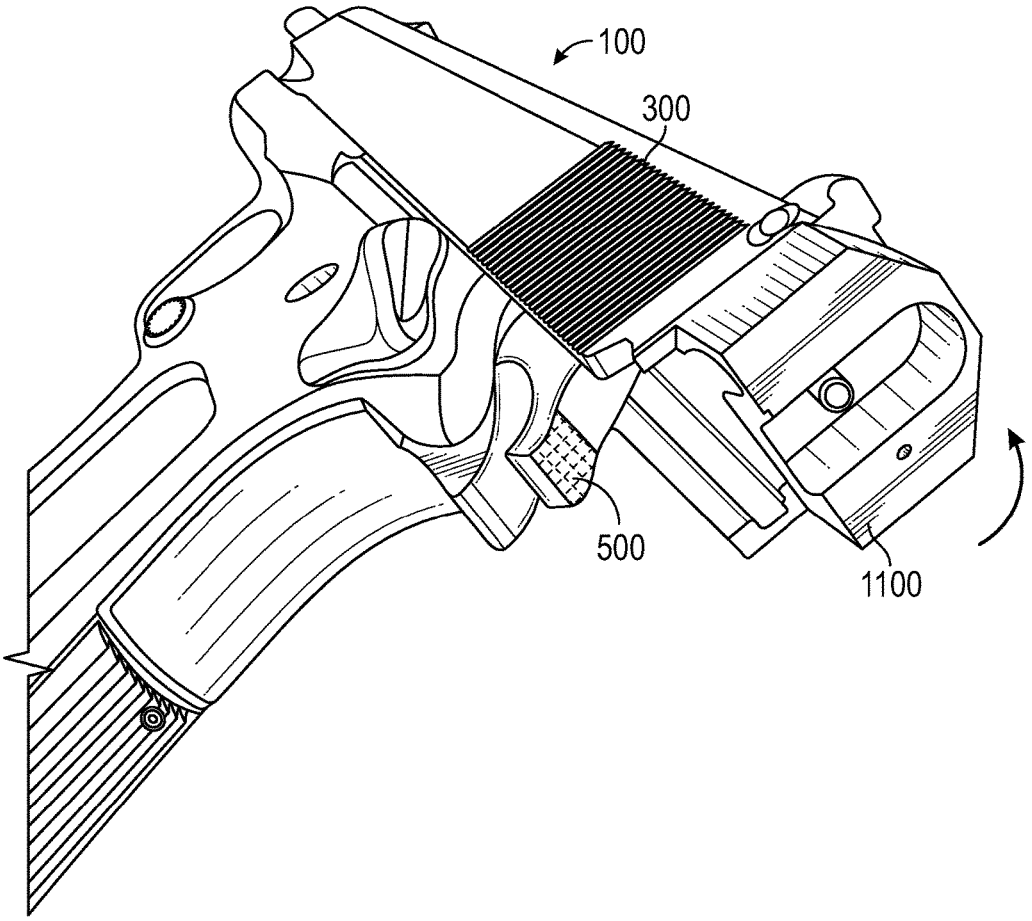
Figure 14:
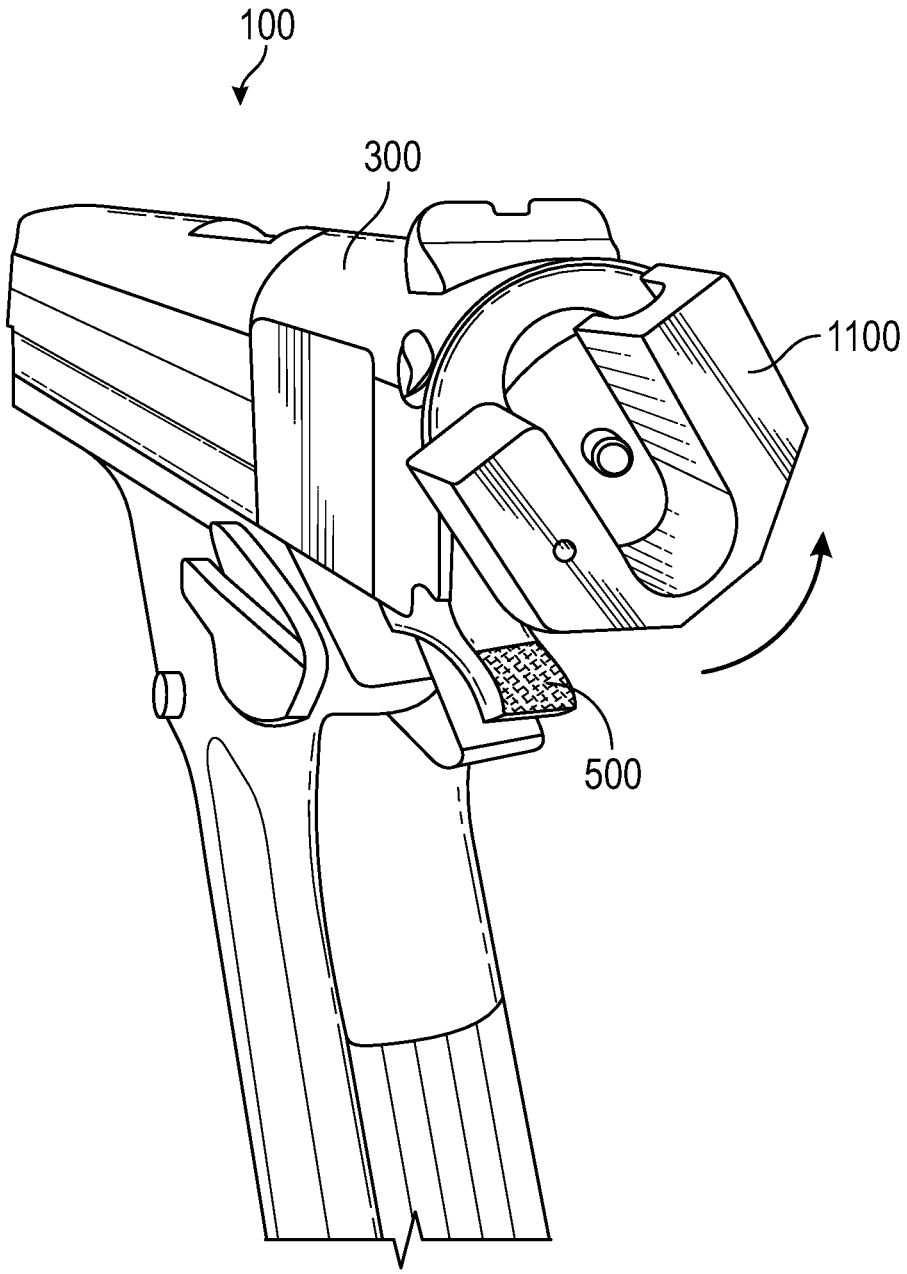
Figure 15:
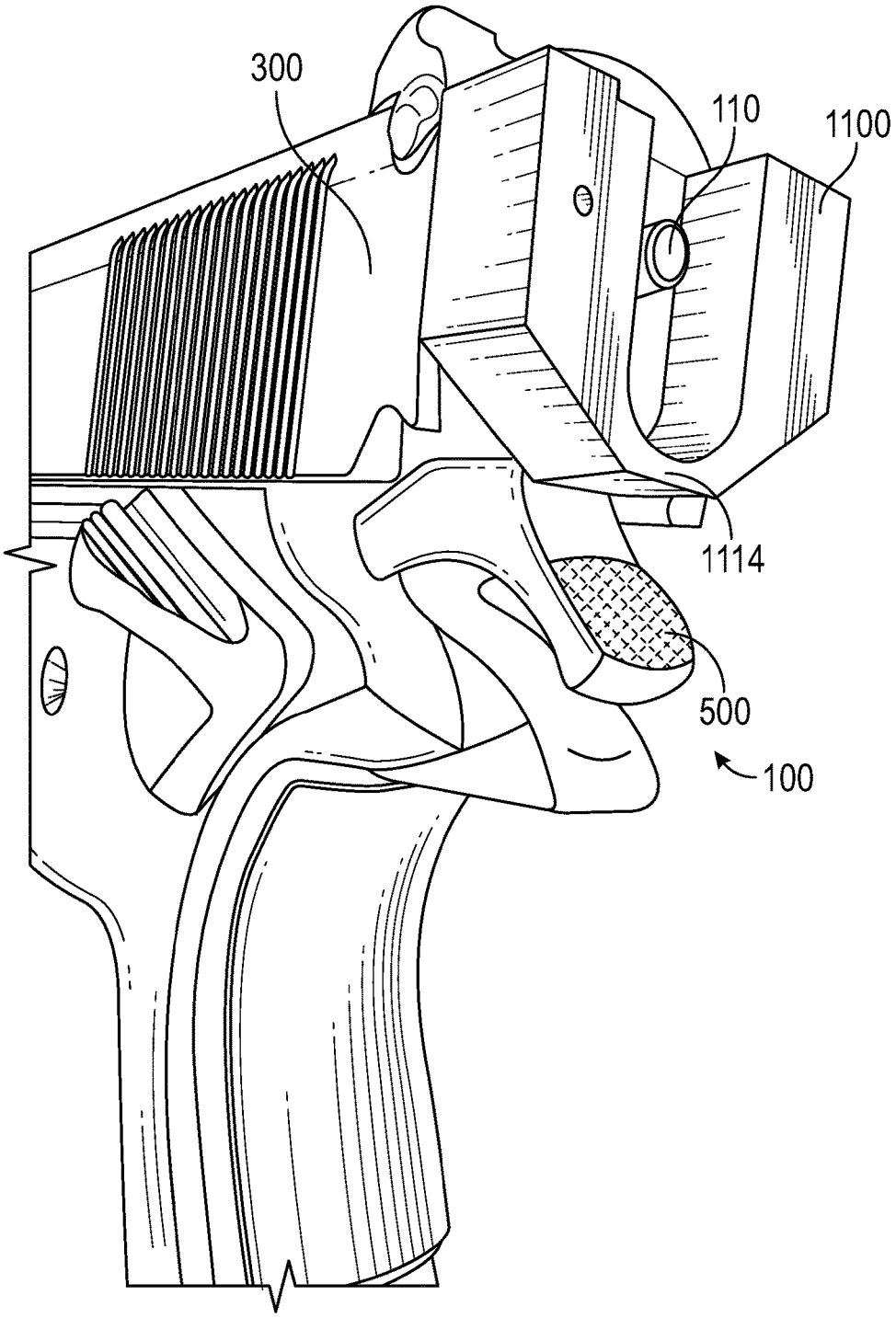
Figure 16:
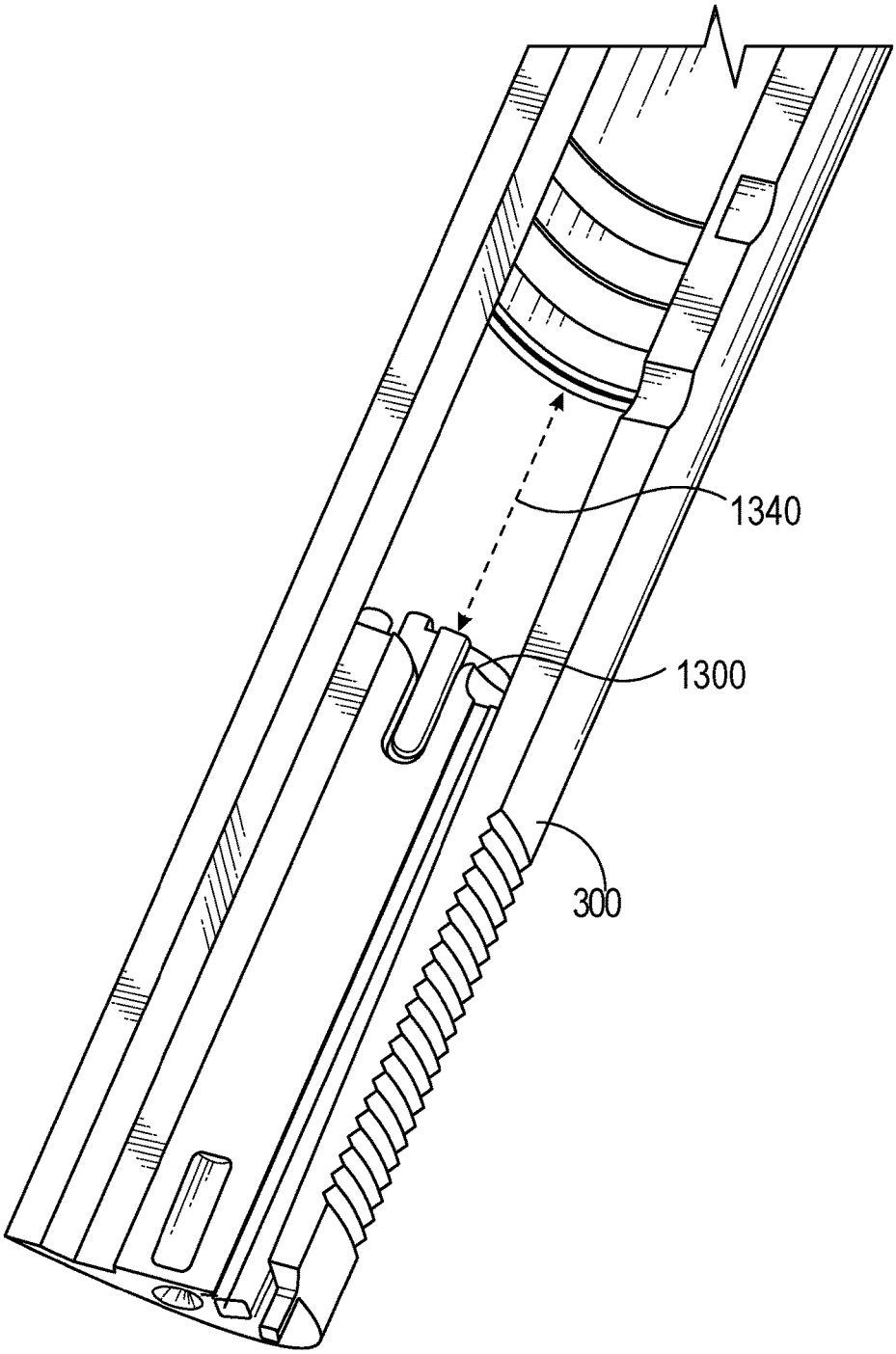
FIGS. 16 and 17 are perspective views of the slide of the firearm of FIG. 1 with the bolt assembly thereof in various orientations, according to an exemplary embodiment.
Figure 17:
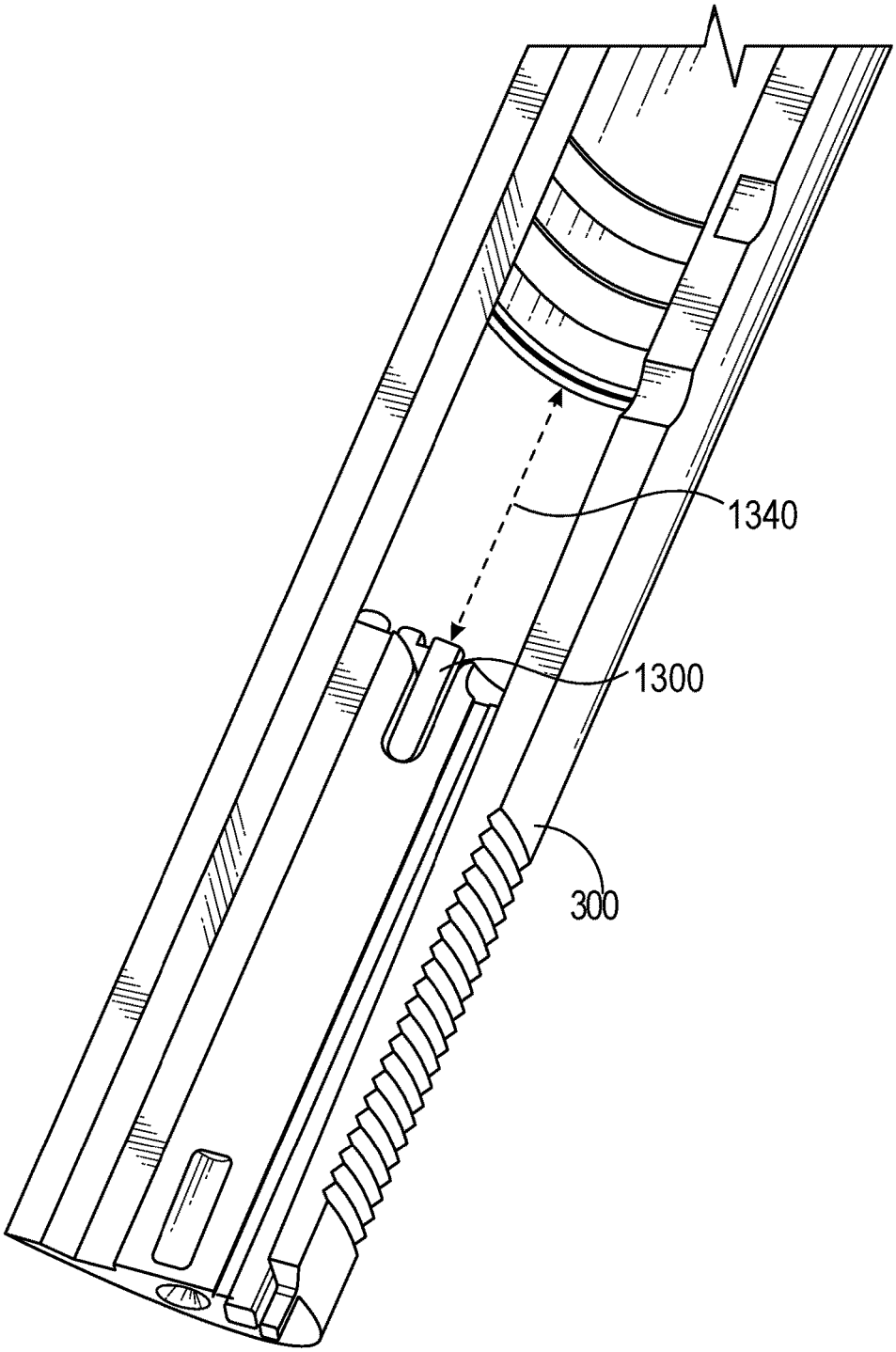
Figure 18:
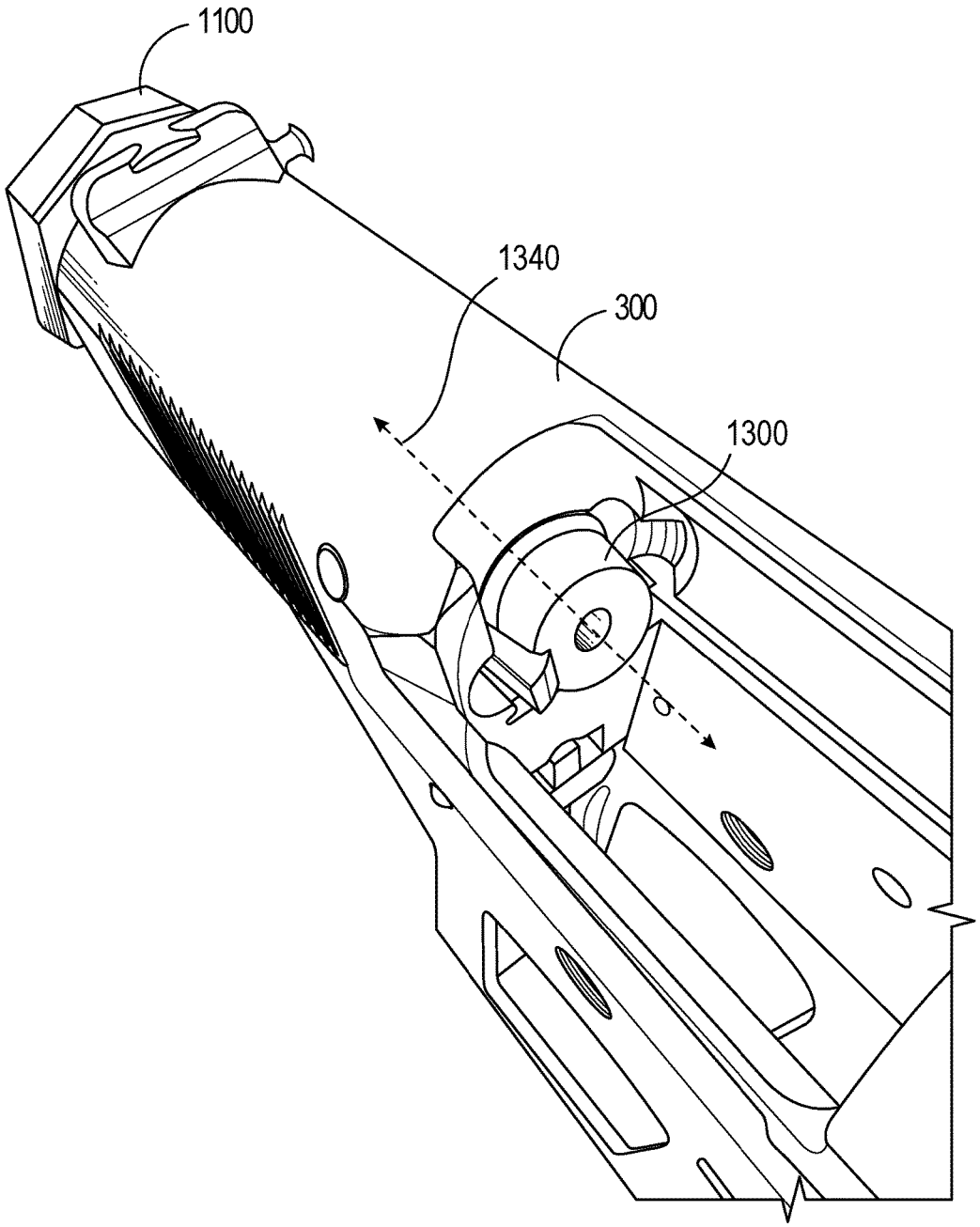
FIGS. 18 and 19 are perspective views of the firearm of FIG. 1 with the bolt assembly thereof in various orientations, according to an exemplary embodiment.
Figure 19:
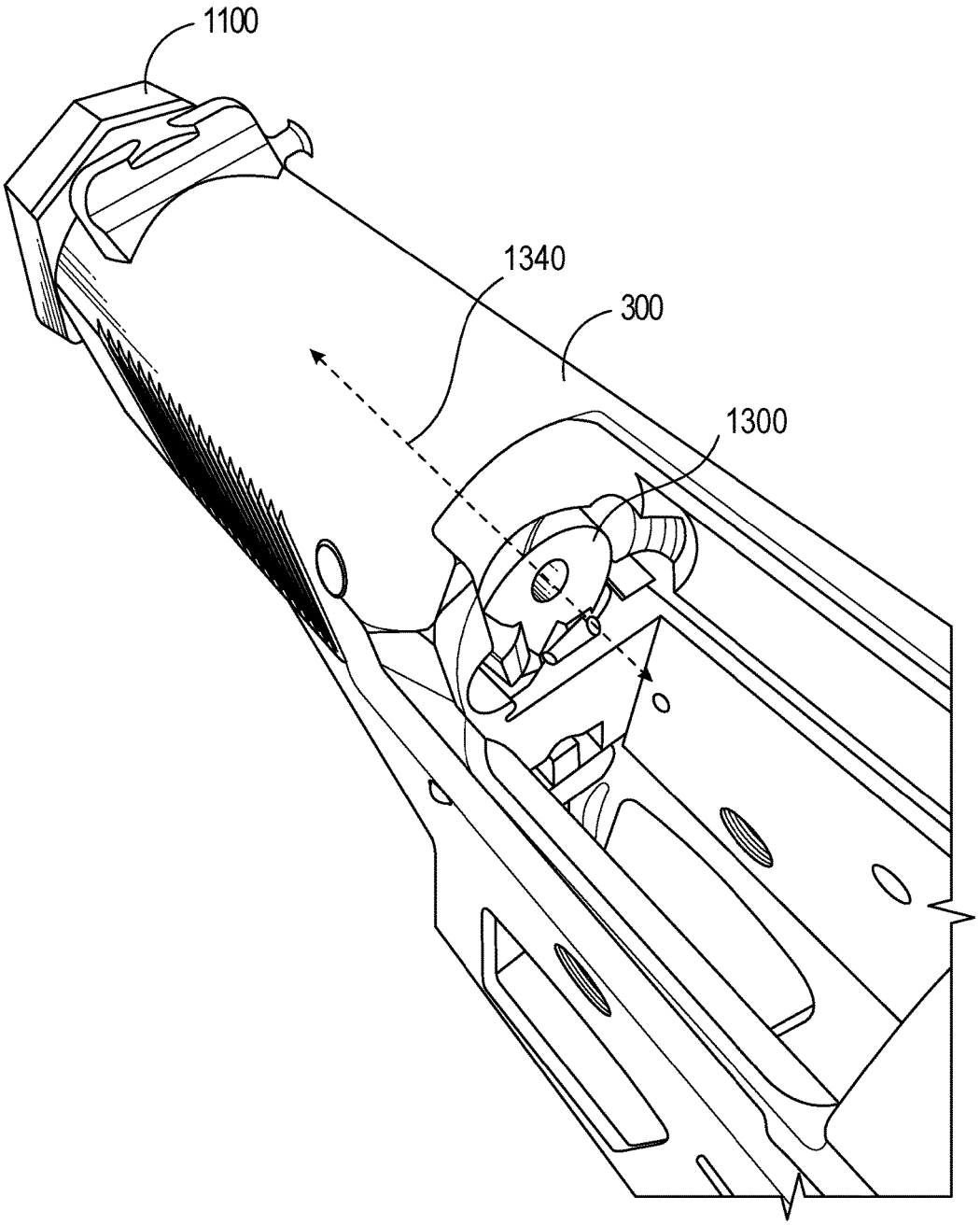

As shown in FIGS. 11-19, knob 1100 is rotatable relative to slide assembly 300. As shown in FIGS. 11 and 12, slide assembly is oriented in a battery position. Knob 1100 is shaped and/or otherwise configured to interfere with hammer 500 to prevent substantial rotation of hammer 500 relative to slide assembly 300. Such interference may reduce the risk of inadvertent repositioning of bolt assembly 1300 with pistol 100 loaded. As shown in FIGS. 13 and 14, knob 1100 is freely rotatable with slide assembly 300 positioned in a locked-back or otherwise withdrawn orientation. Knob 1100 may be rotatable counter-clockwise from an initial position, shown in FIG. 13, to an intermediate position, shown in FIG. 14, and ultimately back to the initial position. As shown in FIG. 15, rim 1114 of knob 1100 interferes with hammer 500 if slide assembly 300 is released from the locked-back or otherwise withdrawn orientation and knob 1100 is disposed in any position other than the initial position or another orientation 360 degrees offset therefrom. With slide assembly 300 released from the locked-back or otherwise withdrawn orientation and knob 1100 not in the initial position or another orientation 360 degrees offset therefrom, rim 1114 and/or another portion of knob 1100 is disposed between firing pin 910 and hammer 500. Knob 1100 may thereby prevent inadvertent engagement of firing pin 910 (i.e., inadvertent firing of pistol 100, etc.) by permitting contact between hammer 500 and firing pin 910 only when knob 1100 is in one of two prescribed position (e.g., the first position or the second position, etc.).

Knob 1100 may thereby be rotatable 360 degrees in either direction (e.g., clockwise, counter-clockwise, etc.). Engagement between second pin 214 and trailing edge 1334 and leading edge 1332 of bolt assembly 1300 may limit further rotation of adjuster 1100. By way of example, in the orientation shown in FIG. 13, bolt assembly 1300 may be in the first position with second pin 214 contacting trailing edge 1334 of bolt assembly 1300. Rotation clockwise from the initial positions shown in FIG. 13 may be limited (e.g., prevented, etc.) due to engagement of second pin 214 with trailing edge 1334 of bolt assembly 1300. Rotation counter-clockwise from the initial position shown in FIG. 13 may occur as adjuster 1200 draws bolt assembly 1300 back and second pin 214 slides across adjoining surface 1336 until second pin 214 contacts leading edge 1332 of bolt assembly 1300. Further counter-clockwise rotation may be limited (e.g., prevented, etc.) due to engagement of second pin 214 with leading edge 1332 of bolt assembly 1300. Knob 1100 may thereby turn adjuster 1200 to reconfigure bolt assembly 1300 between the first position, shown in FIGS. 16 and 18, and the second position, shown in FIGS. 17 and 19.

Figure 20:
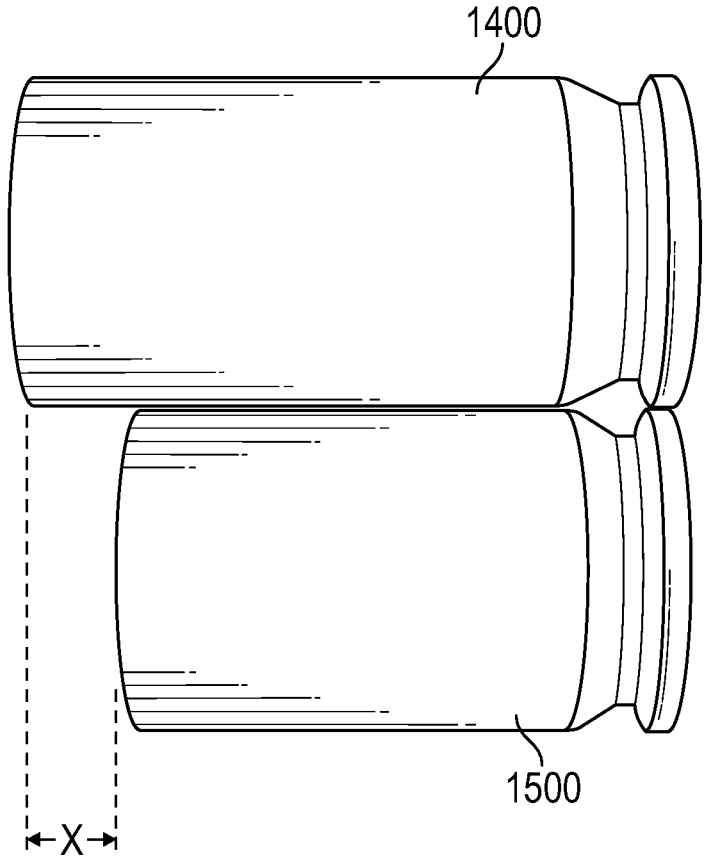
FIG. 20 is a perspective view of two shell casings that the firearm of FIG. 1 is configured to interchangeably fire, according to an exemplary embodiment.
Figure 21:
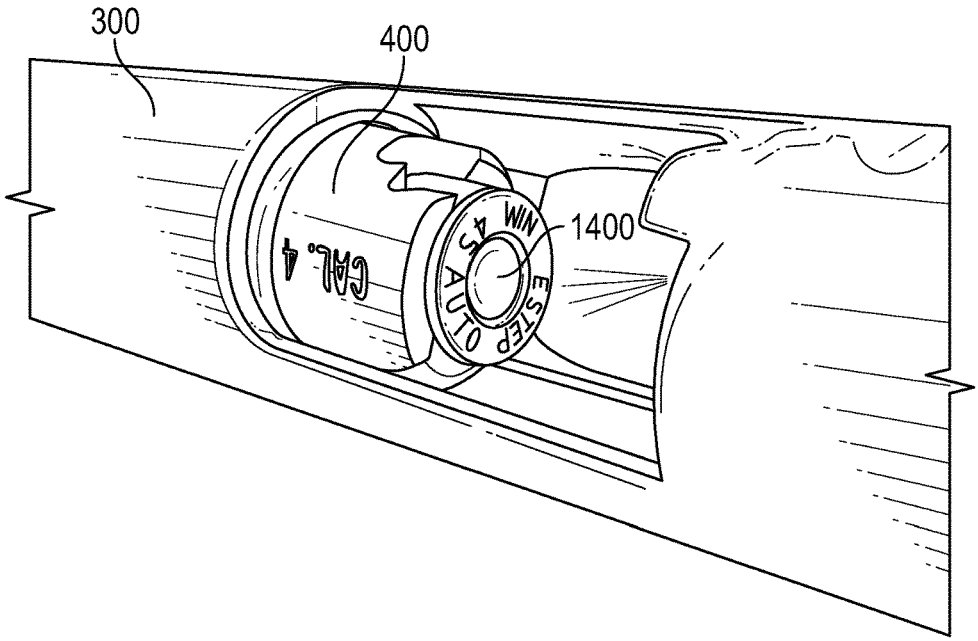
FIGS. 21 and 22 are perspective views of two shell casings positioned within a chamber of the firearm of FIG. 1, according to an exemplary embodiment.
Figure 22:
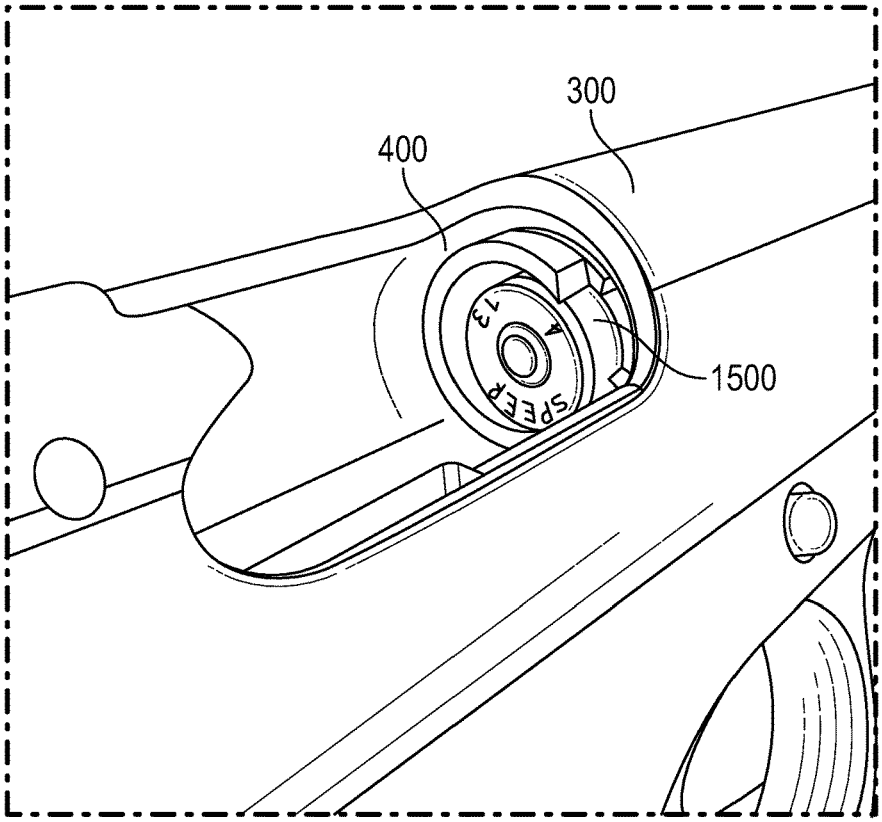

As shown in FIGS. 20-22, adjuster assembly 1000 facilitates firing cartridges having bullets of the same diameter and the same style casings but with different casing lengths. Pistol 100 may interchangeably fire a first casing, shown as first casing 1400, and a second casing, shown as second casing 1500. As shown in FIG. 20, first casing 1400 is a distance X longer than second casing 1500. In one embodiment, first casing 1400 is a 0.45 ACP casing, and second casing 1500 is a 0.45 GAP casing. As shown in FIG. 21, first casing 1400 is disposed within the bore of barrel 400. As shown in FIG. 22, second casing 1500 is disposed within the bore of barrel 400. Second casing 1500 is shorter than first casing 1400 and is thereby recessed into the end of barrel 400 relative to the position of first casing 1400. In one embodiment, adjuster assembly 1000 repositions bolt assembly 1300 to accommodate first casing 1400 when bolt assembly 1300 is in the second position and accommodate second casing 1500 when bolt assembly 1300 is in the first position.

Figure 23:
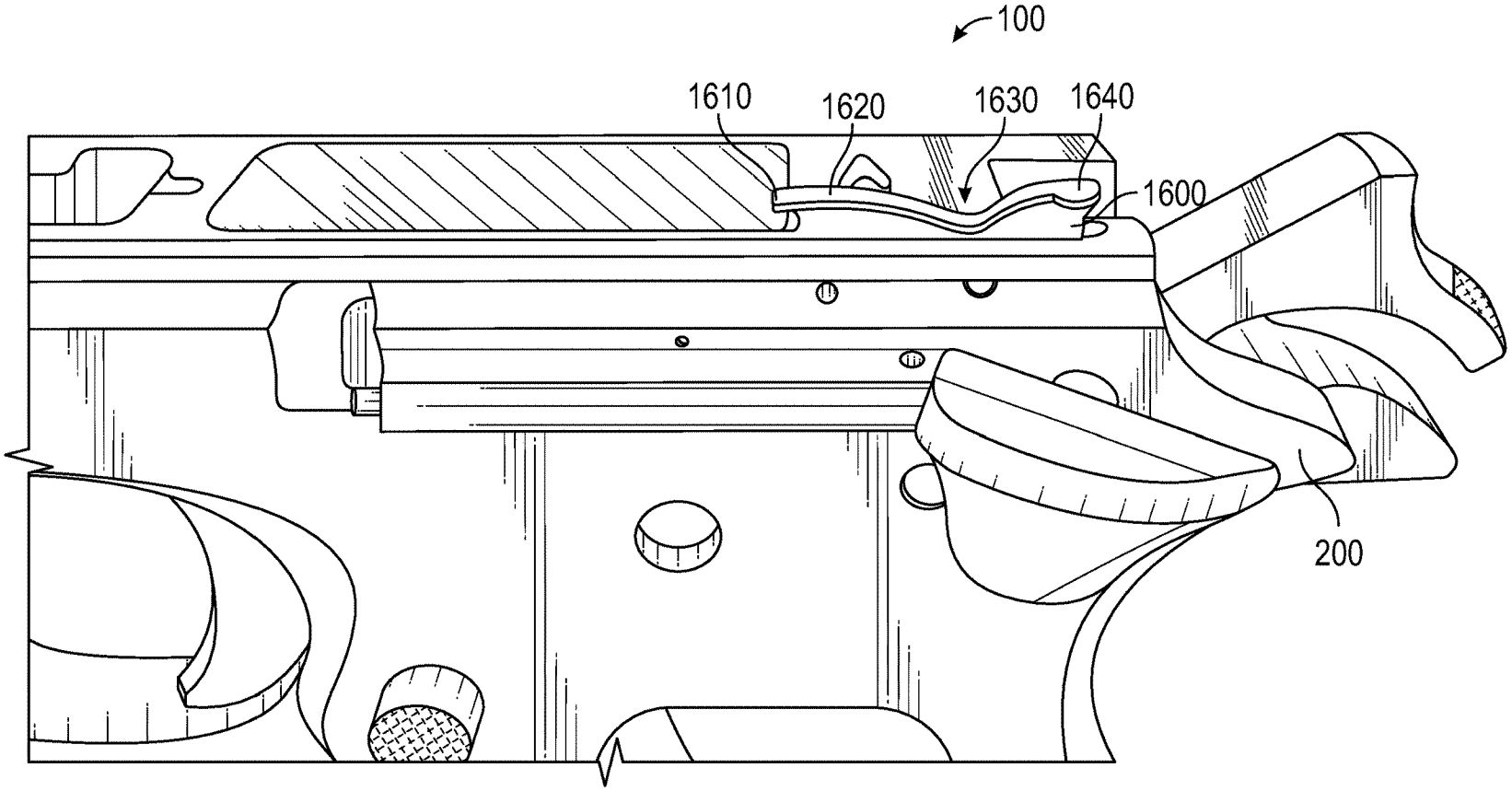
FIGS. 23 and 24 are perspective views of an ejector of the firearm of FIG. 1, according to an exemplary embodiment.
Figure 24:
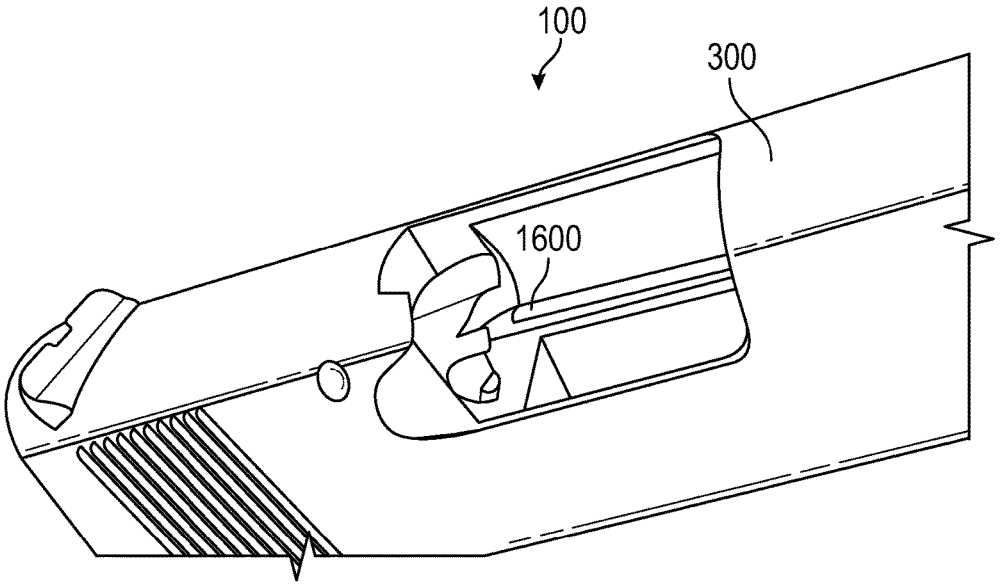

As shown in FIGS. 23 and 24, pistol 100 is particularly configured to eject casings. According to an exemplary embodiment, pistol 100 includes an ejector, shown as ejector 1600. Ejector 1600 is pivotally coupled to frame assembly 200 of pistol 100, according to an exemplary embodiment. As shown in FIG. 23, ejector 1600 includes a leading point, shown as leading point 1610, a leading surface, shown as leading surface 1620, a depression, shown as depression 1630, and a trailing surface, shown as trailing surface 1640. Leading point 1610 contacts the casing to eject the casing as slide assembly 300 moves backward after firing. As shown in FIGS. 23 and 24, ejector 1600 is disposed in a level orientation (e.g., flat, horizontal, not rocked forward, not rocked backward, etc.) when slide assembly 300 is in battery (e.g., with pistol 100 loaded, with pistol 100 unloaded, etc.).

Figure 25:
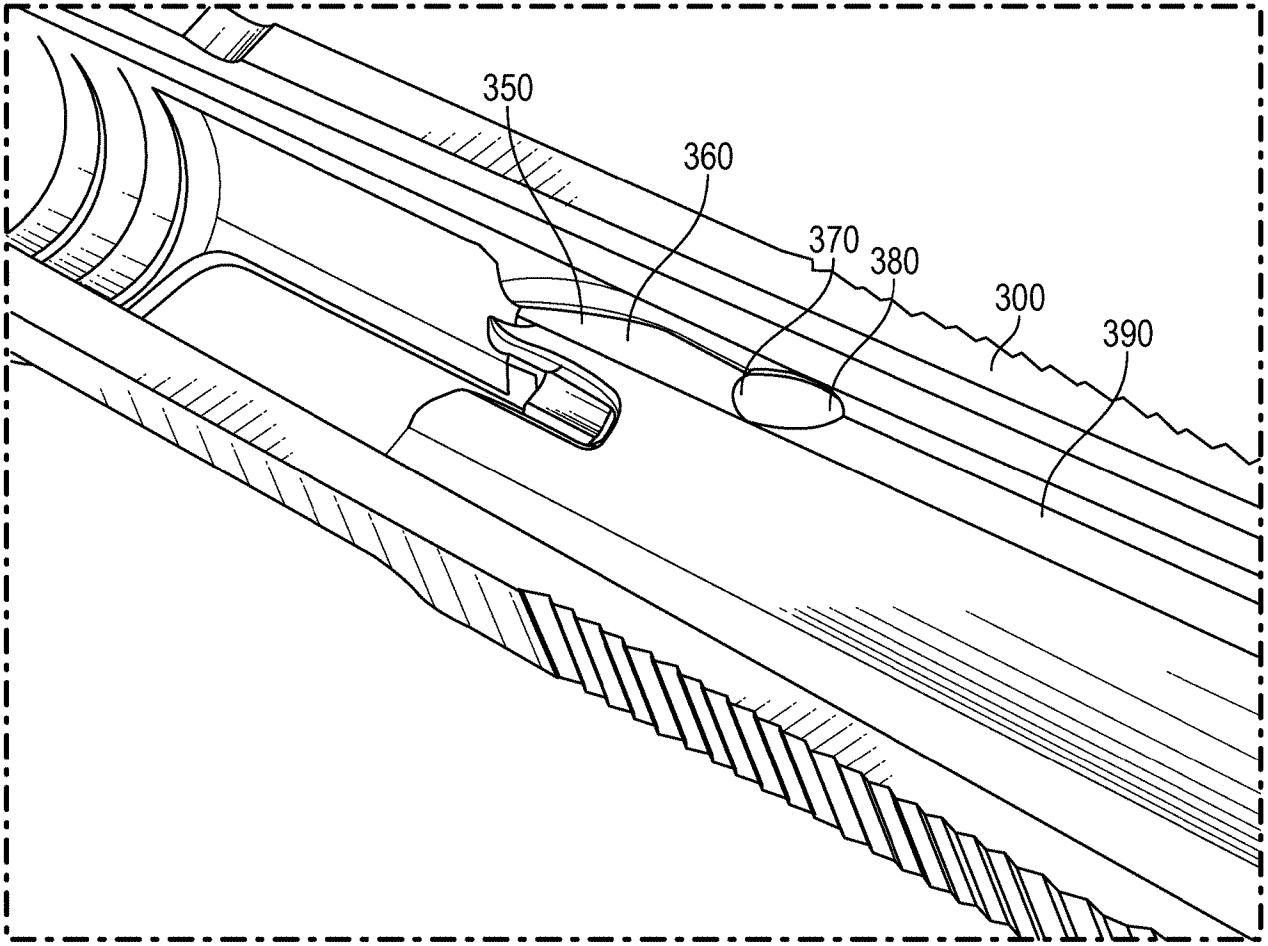
FIG. 25 is a perspective view of the slide of the firearm of FIG. 1, according to an exemplary embodiment.
Figure 26:
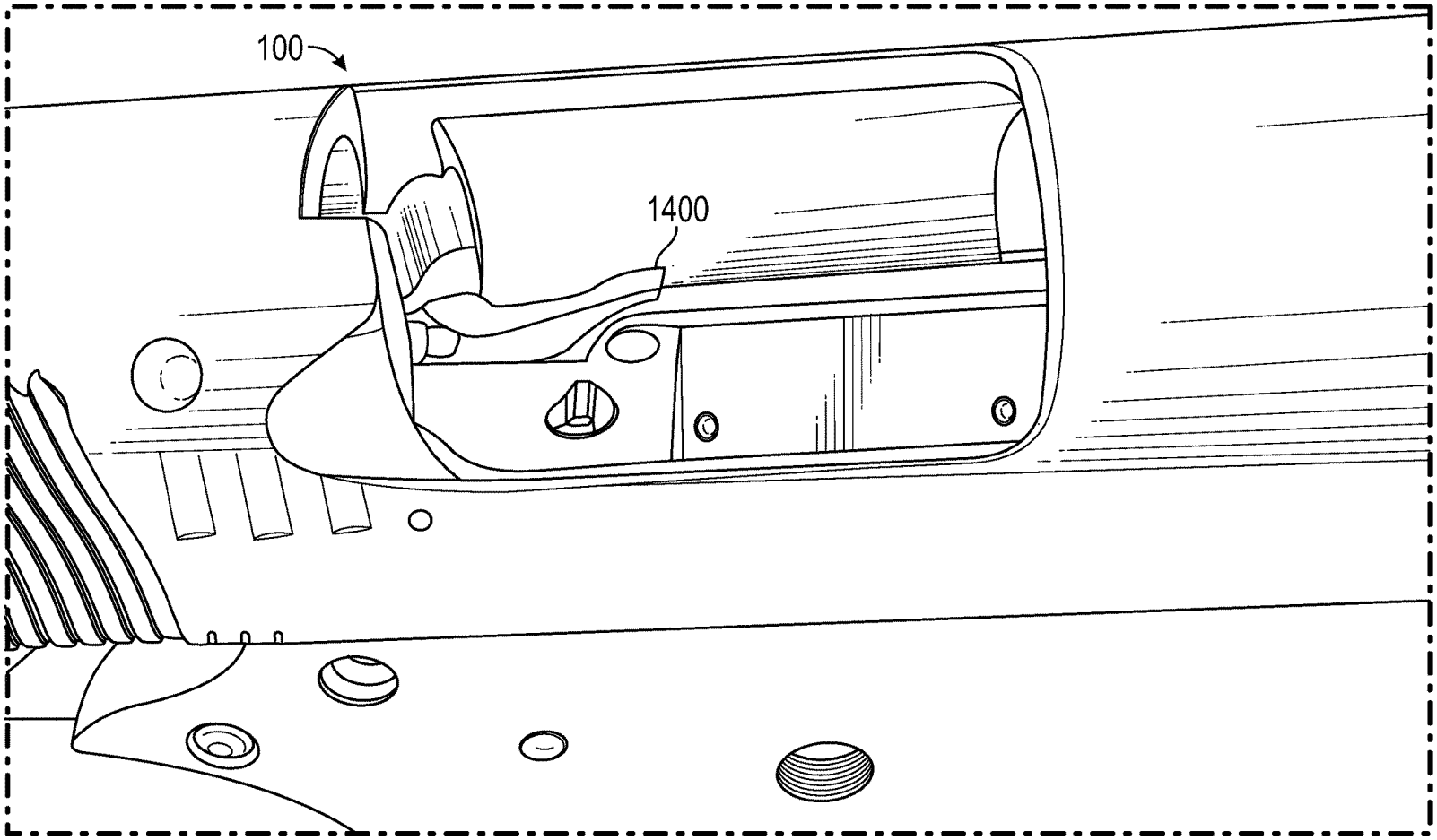
FIG. 26 is another perspective view of an extractor of the firearm of FIG. 1, according to an exemplary embodiment.

Slide assembly 300 includes a plurality of ramps and recesses that accommodate and actuate ejector 1600. As shown in FIG. 25, slide assembly 300 includes a leading ramp, shown as leading ramp 350, a mound, shown as mound 360, a trailing ramp, shown as trailing ramp 370, and a depression, shown as depression 380. In one embodiment, leading surface 1620 of ejector 1600 is disposed along leading ramp 350, depression 1630 of ejector 1600 receives mound 360, and trailing surface 1640 of ejector 1600 is disposed along trailing ramp 370 when slide assembly 300 is in battery. As slide assembly 300 moves rearward, trailing ramp 370 of slide assembly 300 engages trailing surface 1640 of ejector 1600. Trailing ramp 370 and trailing surface 1640 are shaped (e.g., curved, ramped, etc.) such that further rearward motion of slide assembly 300 toggles ejector 1600 (e.g., clockwise when viewed as shown in FIG. 23, etc.) and brings leading point 1610 upward into the position shown in FIG. 26. Contact between the casing and leading point 1610 ejects the casing from the chamber of pistol 100. As slide thereafter moves forward, leading ramp 350 of slide assembly 300 engages leading surface 1620 of ejector 1600. Leading ramp 350 and leading surface 1620 are shaped (e.g., curved, ramped, etc.) such that further forward motion of the slide toggles ejector 1600 (e.g., counter-clockwise when viewed as shown in FIG. 23, etc.) and brings leading point 1610 downward. Ejector 1600 and pistol 100 having slide assembly 300 that toggles ejector 1600 facilitates providing enhanced structural material around bore 320 of slide assembly 300. As shown in FIGS. 10 and 25, slide assembly 300 includes a slot, shown as slot 390, that receives ejector 1600. Pistol 100 having an articulating ejector 1600 facilitates providing an increased thickness t between the wall of bore 320 and the slot 390.

Figure 27:
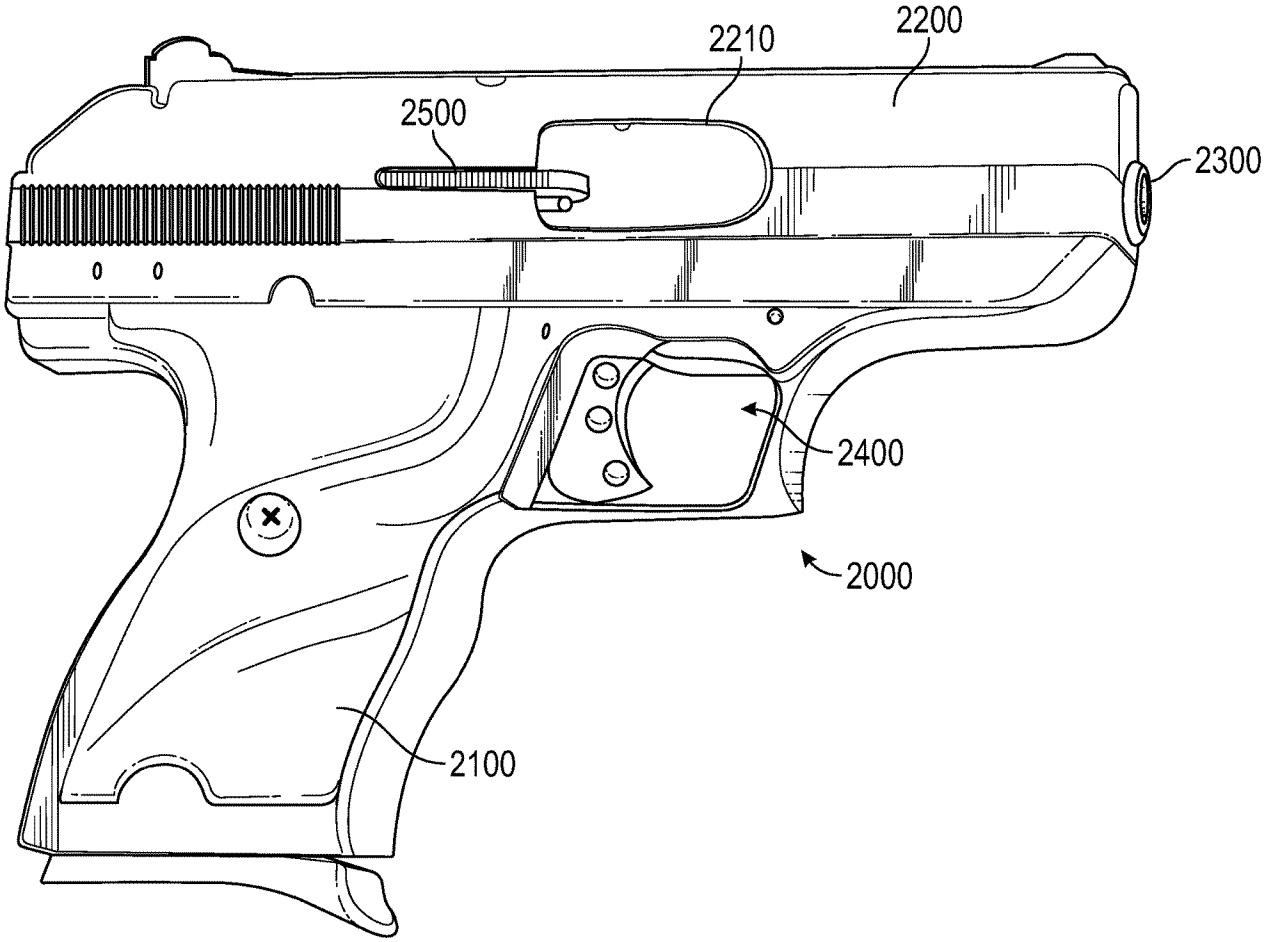
FIG. 27 is a side view of a blow back and/or gas delayed blow back operated firearm having an adjuster assembly, according to another exemplary embodiment.
Figure 28:
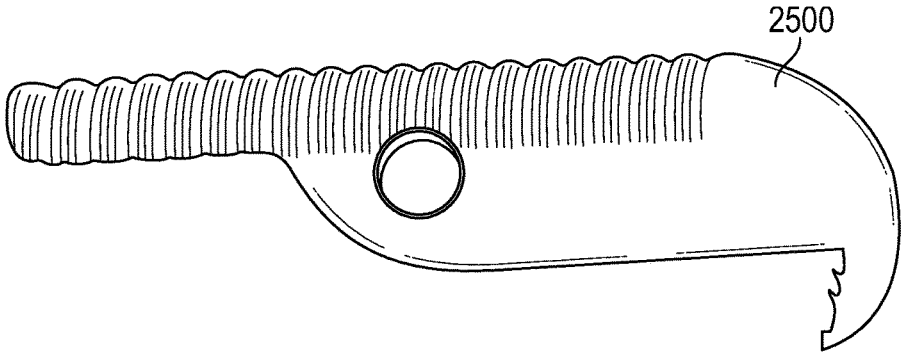
FIG. 28 is a side view of an ejector of the firearm of FIG. 27, according to an exemplary embodiment.
Figure 29:
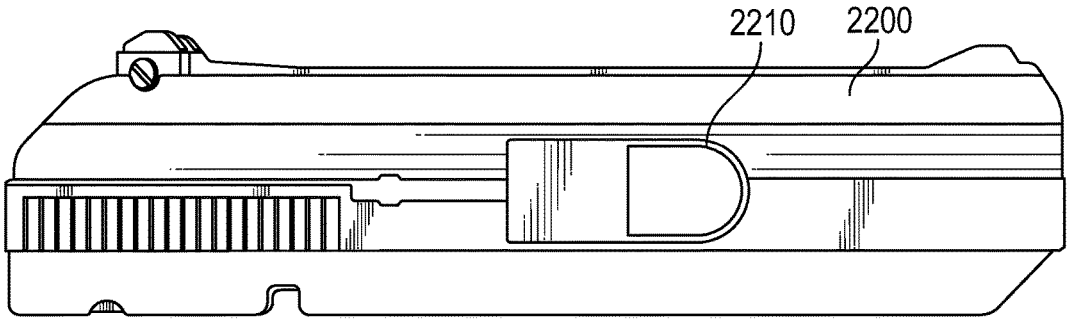
FIG. 29 is a side view of a slide of the firearm of FIG. 27, according to an exemplary embodiment.

According to the exemplary embodiment shown in FIG. 27, a blowback and/or gas delay blowback firearm, shown as pistol 2000, includes a frame assembly, shown as frame assembly 2100, a slide assembly, shown as slide assembly 2200, and a barrel, shown as barrel 2300. Slide assembly 2200 is releasably and slidably coupled to frame assembly 2100. Slide assembly 2200 defines an aperture 2210 that exposes a chamber of pistol 2000. In one embodiment, aperture 2210 extends further forward (e.g., further toward the muzzle of barrel 2300, etc.) relative to corresponding apertures of similar blowback operated firearms. As shown in FIGS. 27 and 28, pistol 2000 also includes a trigger assembly, shown as trigger assembly 2400, and an extractor, shown as extractor 2500. Pistol 2000 may alternatively include more or fewer components.

Figure 30:
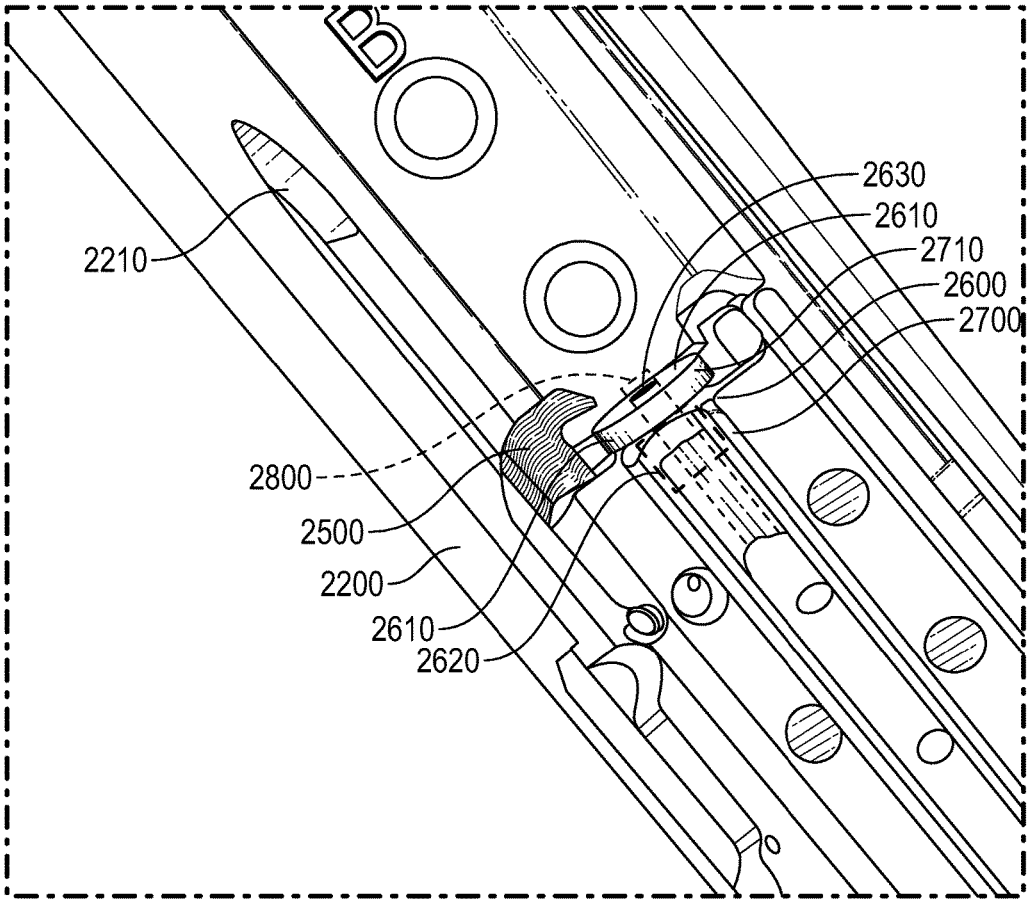
FIG. 30 is a perspective view of an adjuster assembly of the firearm of FIG. 27, according to an exemplary embodiment.

According to the exemplary embodiment shown in FIG. 30, pistol 2000 includes an adjuster assembly, shown as adjuster assembly 2600. In one embodiment, adjuster assembly 2600 is configured to selectively reposition a rear portion of a cartridge relative to barrel 2300 thereby providing increased flexibility to the operator in that cartridges having different casing lengths may be interchangeably fired from pistol 2000. As shown in FIG. 30, adjuster assembly 2600 includes an adjuster having a body, shown as body 2610, and an extension, shown as extension 2620. In other embodiments, the adjuster does not include extension 2620. According to the exemplary embodiment shown in FIG. 30, extension 2620 couples body 2610 to a bolt assembly, shown as bolt assembly 2700, of pistol 2000. Body 2610 and extension 2620 include an aperture, shown as aperture 2630, that receives a firing pin, shown as firing pin 2800, of pistol 2000. Firing pin 2800 engages a primer of a cartridge as pistol 2000 is fired. Adjuster assembly 2600 spaces the rear portion of a cartridge from a surface 2710 of bolt assembly 2700. In traditional firearms, the cartridge would interface with (e.g., contact, etc.) surface 2710 of bolt assembly 2700. Body 2610 of adjuster assembly 2600 may have a thickness that corresponds with (e.g., is equal to, etc.) the difference in length between the two casings pistol 2000 is configured to interchangeably fire. By way of example, pistol 2000 may have head spacing equal to the distance between the surface the rear of the casing engages and barrel 2300. Pistol 2000 without adjuster assembly 2600 may have head spacing equal to the distance between surface 2710 and barrel 2300. Pistol 2000 with adjuster assembly 2600 may have head spacing equal to the distance between a leading surface 2612 of body 2610 and barrel 2300. Pistol 2000 without adjuster assembly 2600 may have head spacing selected to correspond with the length of a 9 mm caliber casing. A .380 caliber casing has a smaller diameter and a shorter length than a 9 mm caliber casing. Adjuster assembly 2600 may provide head spacing to accommodate the .380 caliber casing. By way of example, body 2610 may have a thickness equal to the difference in length between a .380 caliber casing and a 9 mm caliber casing. In one embodiment, aperture 2210 of slide assembly 2200 extends further forward (e.g., further toward the muzzle of barrel 2300, etc.) relative to corresponding apertures of similar blowback operated firearms (e.g., a distance equal to the thickness of a portion of body 2610, etc.).

The front edges of both casings may sit at the same front position, but the back edges thereof may be at different positions (e.g., due to the difference in casing lengths. Extractor 2500 may be longer than ejectors of traditional pistols (e.g., longer than a 9 mm extractor, etc.). Extractor 2500 thereby accommodates removing shorter casings from a chamber of pistol 2000.

In another embodiment, pistol 2000 without adjuster assembly 2600 may have head spacing selected to correspond with the length of a 10 mm caliber casing, and adjuster assembly 2600 may provide head spacing to accommodate a .40 caliber casing. Slide assembly 2200 may be oriented in a full battery position when the shorter shell option is chambered and may be oriented in a second position (e.g., slightly rearward relative to the full battery position, etc.) when the longer shell option is chambered.

Slide assembly 2200 facilitates firing pistol 2000 even with slide assembly 2200 oriented in the second position (e.g., slide assembly 2200 may be designed such that the safety of pistol 2000 does not prevent firing even if slide assembly 2200 is not in full battery, etc.). By way of example, slide assembly 2200 may include one or more apertures (e.g., grooves, etc.) where slides of traditional pistols would include material that engages with a safety mechanism to prevent firing. By way of another example, slide assembly 2200 may include a projection where slides of traditional pistols would not include material.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. A firearm, comprising:

a frame;

a slide assembly comprising a threaded bore, the slide assembly releasably and slidably coupled to the frame;

an actuator including a body and an extension, wherein the extension protrudes from the body;

a bolt assembly including a catch; and an adjuster comprising:

a first end and a second end, wherein the first end includes an interface configured to accommodate the extension of the actuator, wherein the second end includes a coupler configured to engage with the catch of the bolt assembly; and a plurality of threads disposed between the first end and the second end, the plurality of threads configured to interface with the threaded bore of the slide assembly such that rotation of the adjuster within the threaded bore of the slide assembly by the actuator translates the bolt assembly and thereby facilitates firing ammunition having different casing lengths.

2. The firearm of claim 1, wherein the adjuster and the extension of the actuator are rotatably coupled such that rotation of the actuator rotates the adjuster and thereby translates the adjuster along the threaded bore.

3. The firearm of claim 2, wherein the body of the actuator defines a recess, the recess extending to and through a lower end of the body, the body thereby configured to accommodate a hammer of the firearm.

4. The firearm of claim 3, further comprising a firing pin, wherein the body and the extension of the actuator define a first bore and a second bore, respectively, positioned along a common central axis, wherein the first bore is defined by the body of the actuator and the second bore is defined by the extension of the actuator, wherein the first bore and the second bore receive the firing pin, wherein the firing pin protrudes from the first bore and into the recess when disposed in a withdrawn position and is thereby oriented for contact by the hammer.

5. The firearm of claim 4, wherein the adjuster defines a third bore and the bolt assembly defines a fourth bore, the first bore, the second bore, the third bore, and the fourth bore disposed along the common central axis.

6. The firearm of claim 5, wherein the bolt assembly is coupled to the adjuster such that rotation of the actuator rotates the adjuster and translates the bolt assembly in a direction that is parallel to the common central axis.

7. The firearm of claim 6, wherein the body of the actuator is rotatable between (a) a first position in which the body facilitates entrance of the hammer into the recess, into contact with the firing pin and (b) a plurality of secondary positions in which the body prevents the hammer from entering the recess and thereby prevents the hammer from contacting the firing pin.

8. The firearm of claim 7, wherein the body of the actuator comprises a rim and a pair of wings, the rim and the pair of wings collectively defining closed portions of the body that prevent the hammer from entering the recess and contacting the firing pin when the actuator is not in the first position.

9. The firearm of claim 6, further comprising a pin, wherein the slide assembly defines an aperture, wherein the pin is disposed within the aperture, wherein the bolt assembly comprises a slot having a length defined by a leading edge and a trailing edge, wherein the pin is disposed within the slot of the bolt assembly, the length of the slot limiting translational movement of the bolt assembly to a predetermined threshold amount.

* * * * *